US012098471B1

(12) United States Patent
Wang et al.

(10) Patent No.: US 12,098,471 B1
(45) Date of Patent: Sep. 24, 2024

(54) WATER-IN-SALT ELECTROLYTE FOR ELECTROCHEMICAL REDOX REACTIONS

(71) Applicant: The Trustees of Boston College, Chestnut Hill, MA (US)

(72) Inventors: Dunwei Wang, Newton, MA (US); Qi Dong, Newton, MA (US); Xizi Zhang, Berkeley, CA (US)

(73) Assignee: The Trustees of Boston College, Chestnut Hill, MA (US)

( * ) Notice: Subject to any disclaimer, the term of this patent is extended or adjusted under 35 U.S.C. 154(b) by 0 days.

(21) Appl. No.: 18/175,782

(22) Filed: Feb. 28, 2023

Related U.S. Application Data

(63) Continuation of application No. 17/123,578, filed on Dec. 16, 2020, now Pat. No. 11,639,554.

(60) Provisional application No. 62/948,377, filed on Dec. 16, 2019.

(51) Int. Cl.

| | |
|---|---|
| ***C25B 9/15*** | (2021.01) |
| ***C25B 1/04*** | (2021.01) |
| ***C25B 1/23*** | (2021.01) |
| ***C25B 9/19*** | (2021.01) |
| ***C25B 11/032*** | (2021.01) |
| ***C25B 11/077*** | (2021.01) |
| ***C25B 11/081*** | (2021.01) |
| ***C25B 15/02*** | (2021.01) |

(52) U.S. Cl.
CPC ..... *C25B 9/15* (2021.01); *C25B 1/04* (2013.01); *C25B 1/23* (2021.01); *C25B 9/19* (2021.01); *C25B 11/032* (2021.01); *C25B 11/077* (2021.01); *C25B 11/081* (2021.01); *C25B 15/02* (2013.01)

(58) Field of Classification Search
CPC ..... C25B 1/23; C25B 3/26
See application file for complete search history.

(56) References Cited

FOREIGN PATENT DOCUMENTS

| | | |
|---|---|---|
| JP | 2018530141 A | 10/2018 |
| WO | 2015116700 A1 | 8/2015 |

OTHER PUBLICATIONS

Qi Dong, Xizi Zhang, Da He, Chaochao Lang, Dunwei Wang, Role of H2O in electrochemical CO2 reduction as studied in a water-in-salt system. ACS Cent. Sci. 2019, DOI: 10.1021/acscentsci.9b00519.

Qi Dong, Xiahui Yao, Yanyan Zhao, Miao Qi, Xizi Zhang, Hongyu Sun, Yumin He, Dunwei Wang, Cathodically stable Li—O2 battery operations using water-in-salt electrolyte. Chem 2018, 4, 1345-1358.

(Continued)

*Primary Examiner* — Ciel P Contreras
(74) *Attorney, Agent, or Firm* — Fox Rothschild LLP

(57) ABSTRACT

A flow cell for reducing carbon dioxide may include a first chamber having a gold coated gas diffusion layer working electrode, a reference electrode, and a water-in-salt electrolyte comprising a super concentrated aqueous solution of lithium bis-(trifluoromethanesulfonyl)imide (LiTFSI). A second chamber adjacent the first chamber has a gold coated gas diffusion layer counter electrode and the water-in-salt electrolyte. The second chamber being separated from the first chamber by a proton exchange membrane. A reservoir coupled to each of the first and the second chambers with a pump contains a volume of the water-in-salt electrolyte and a head space.

16 Claims, 19 Drawing Sheets

(56) References Cited

OTHER PUBLICATIONS

Xiahui Yao, Qi Dong, Qingmei Cheng, Dunwei Wang, Why do lithium-oxygen batteries fail: parasitic chemical reactions and their synergistic effect. Angew. Chem. Int. Edit. 2016, 55, 11344-11353.
Liumin Suo, Oleg Borodin, Tao Gao, Marco Olguin, Janet Ho, Xiulin Fan, Chao Luo, Chunsheng Wang, Kang Xu, "Water-in-salt" electrolyte enables high-voltage aqueous lithium-ion chemistries. Science 2015, 350, 938-943.
Yuki Yamada, Kenji Usui, Keitaro Sodeyama, Seongjae Ko, Yoshitaka Tateyama, Atsuo Yamada, Hydrate-melt electrolytes for high-energy-density aqueous batteries. Nat. Energy 2016, 1, 16129.
Chongyin Yang, Liumin Suo, Oleg Borodin, Fei Wang, Wei Sun, Tao Gao, Xiulin Fan, Singyuk Hou, Zhaohui Ma, Khalil Amine, Kang Xu, Chunsheng Wang, Unique aqueous Li-ion/sulfur chemistry with high energy density and reversibility. Proc. Natl. Acad. Sci. USA 2017, 114, 6197-6202.
Yao et al., "Epitaxial Welding of Carbon Nanotube Networks for Aqueous Battery Current Collectors," ACS Nano (May 14, 201). vol. 12, No. 6, pp. 5266-5273. (Year: 2018).

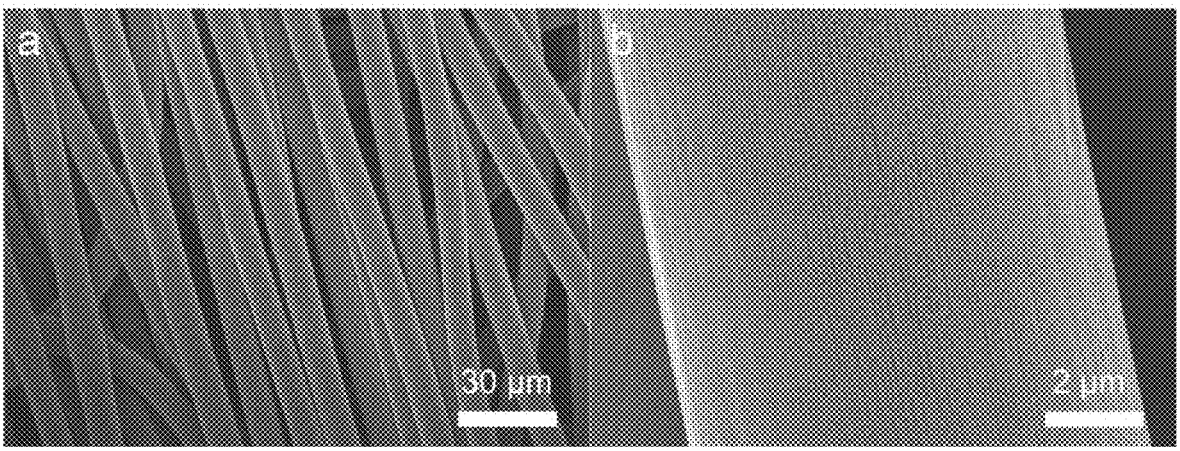
Figure 16A
Figure 16B
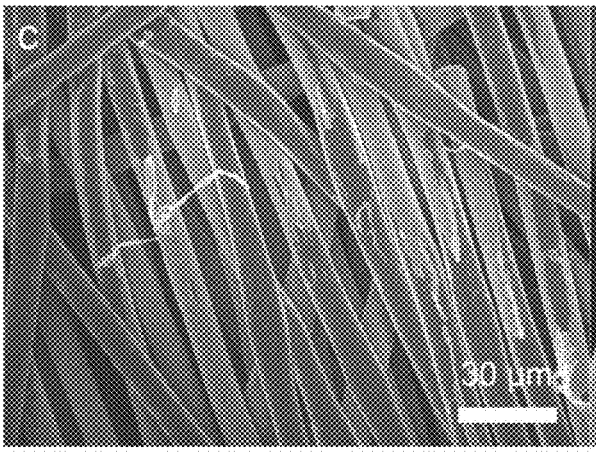
Figure 16C
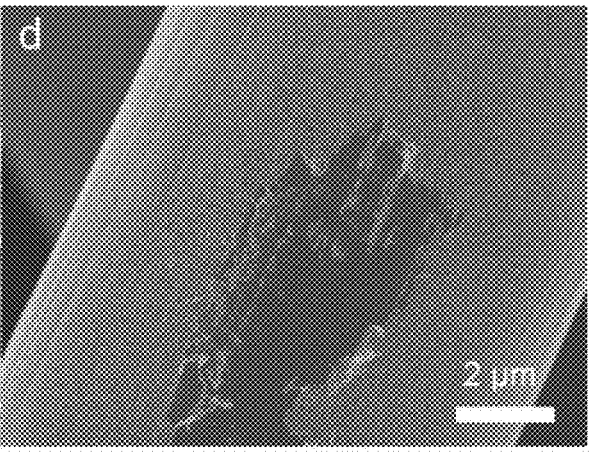
Figure 16D

WATER-IN-SALT ELECTROLYTE FOR ELECTROCHEMICAL REDOX REACTIONS

CROSS-REFERENCE TO RELATED APPLICATIONS

The present invention is a continuation of U.S. patent application Ser. No. 17/123,578, filed Dec. 16, 2020, which claims priority to U.S. provisional application Ser. No. 62/948,377, filed Dec. 16, 2019, the entirety of which are hereby incorporated herein by reference.

STATEMENT OF GOVERNMENT SUPPORT

The current technology was developed using funds supplied by the National Science Foundation (NSF) under grant No. CBET1804085. Accordingly, the U.S. Government has certain rights to this invention.

BACKGROUND OF THE INVENTION

Direct $CO_2$ reduction by methods such as electrochemistry has attracted significant attention. On the one hand, as a key culprit for the greenhouse effect, using $CO_2$ for chemical synthesis holds promises for decreasing its concentrations in atmosphere. On the other hand, $CO_2$ reduction ensures severe thermodynamic and kinetic penalties, often leading to a myriad of products (e.g., hydrocarbons and hydrogen). How to steer the reaction toward desired products represents a fundamentally important challenge. The intense research has indeed greatly advanced our understanding on this reaction. Just within the context of electrochemical reduction of $CO_2$, for instance, we have learned that the product selectivity is highly sensitive to at least two parameters, the nature of the catalyst and the electrolyte. The relative adsorption energy of the intermediates, most notably M-CO (where M represents a metal center), has been understood to dictate the subsequent chemical steps and, hence, the product selectivity. Along this line, various metallic or compound catalysts have been studied, with the oxide-derived metals (e.g., Au and Cu) being perhaps the most notable.

Another method for reducing carbon dioxide is by mimicking natural photosynthesis. The protons and electrons required for reduction of carbon dioxide during photosynthesis are provided by oxidation of water. Thus, there is substantial interest in molecular catalysts for oxidation of water.

SUMMARY OF THE INVENTION $CO_2$ electrochemical reduction is of great interest not only for its technological implications but also for the scientific challenges it represents. One challenge, for example, is that evolution of hydrogen is kinetically favored during the reduction of carbon dioxide. The current disclosure provides a novel strategy involving a unique water-in-salt electrolyte system, where the $H_2O$ concentration can be greatly suppressed due to the strong solvation of the high-concentration salt. Advantageously, suppressing the activity of water using a water-in-salt electrolyte for electrochemical reactions not only reduces the production of hydrogen during reduction of carbon dioxide, it also makes it possible to perform oxidation of water in an aqueous system by moving the activity of water away from unity.

The water-in-salt electrolyte offers an opportunity to tune the $H_2O$ concentration for controlling the electrokinetics of $CO_2$ reduction. In one embodiment, the water-in-salt electrolyte, which is a super concentrated LiTFSI aqueous solution (up to 21 m, 21 mole/kg), is used for carbon dioxide ($CO_2$) electrochemical reduction and to improve the selectivity toward carbon monoxide (CO) production with an Au catalyst.

Thus, in an embodiment, an electrolyte for electrochemical reduction of carbon dioxide may include a super concentrated aqueous solution of lithium bis-(trifluoromethanesulfonyl)imide (LiTFSI).

In an embodiment, a flow cell for reducing carbon dioxide may include a first chamber having a gold coated gas diffusion layer working electrode, a reference electrode, and a water-in-salt electrolyte comprising a super concentrated aqueous solution of lithium bis-(trifluoromethanesulfonyl) imide (LiTFSI). A second chamber adjacent the first chamber has a gold coated gas diffusion layer counter electrode and the water-in-salt electrolyte. The second chamber is separated from the first chamber by a proton exchange membrane. A reservoir contains a volume of the water-in-salt electrolyte and a head space. The reservoir is coupled to each of the first and the second chambers with a pump.

In an embodiment, the water-in-salt electrolyte is used for moving the activity of water away from unity so as to enable electrochemical oxidation of water in an aqueous system. One example of the water-in-salt electrolyte used for oxidation of water is a super concentrated aqueous solution of $NaNO_3$ on a CoOOH electrocatalyst substrate. By choosing appropriate high concentrations of $NaNO_3$, the activity of water could be suppressed significantly in aqueous solutions. In an embodiment, a method of controlling a rate of water oxidation reaction may include providing super concentrated aqueous solution of a salt to form a water-in-salt system as an electrolyte for the electrochemical reaction on a cobalt oxide-based electrocatalyst substrate; and varying a concentration of water in the water-in-salt system during the electrochemical water oxidation.

The water-in-salt electrolyte includes but is not limited to super concentrated LiTFSI aqueous solution. $LiNO_3$, LiCl, $NaClO_4$, NaOH, KOH, KAc, HCOOK, $NaNO_3$, $KNO_3$, $KClO_4$, etc. aqueous electrolyte/solution at high concentrations can also be categorized as "water-in-salt".

This approach of using a water-in-salt electrolyte is broadly applicable to other catalyst systems and catalytic redox reactions (e.g., $H_2O$ oxidation, $CO_2$ reduction, CO reduction, etc.).

The embodiments of the present invention demonstrate features and advantages that will become apparent to one of ordinary skill in the art upon reading the appended Detailed Description.

BRIEF DESCRIPTION OF THE DRAWINGS

FIG. 16A-16D shows the morphology of sputtered Au catalyst coated GDL electrode before and after electrolysis in a 21 m WiS electrolyte by SEM. (A) Overview of the electrode before electrolysis. (B) Enlarged view of the electrode before electrolysis. (C) Overview of the electrode after electrolysis. (D) Enlarged view of the electrode after electrolysis.

DETAILED DESCRIPTION OF THE INVENTION

The present invention is directed to the water-in-salt electrolyte for electrochemical redox reactions.

Without further elaboration, it is believed that one skilled in the art can, based on the above description, utilize the present invention to its fullest extent. The following specific embodiments and examples are, therefore, to be construed as merely illustrative, and not limitative of the remainder of the disclosure in any way whatsoever.

It has been observed that the electrolyte and electrolyte concentration plays a key role electrochemical redox reactions. For example, the mass transport of protons has been exploited to suppress hydrogen evolution reactions (HER) in highly concentrated alkaline solutions. In parallel, the ionic effect is recognized as affecting the product selectivity, attributed to how the ions impact the interactions between $H_2O$ and the substrates (and/or the reaction intermediates). Nonetheless, detailed processes in a $CO_2$ electrochemical reduction reaction or an electrochemical $H_2O$ oxidation reaction are ill understood, especially at the molecular level.

Figure 1:
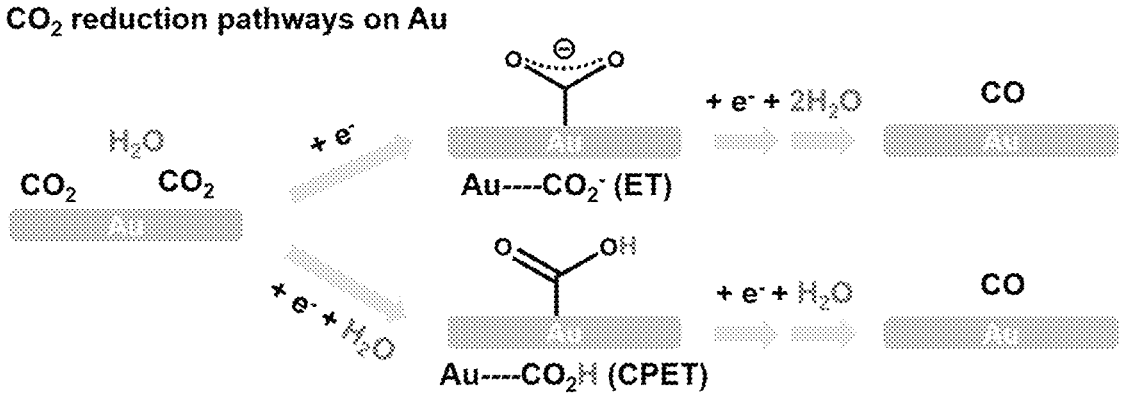
FIG. 1 shows a schematic illustration of possible reaction pathways of two different mechanisms during $CO_2$ electrochemical reduction on Au catalyst. Top: electron transfer (ET) is RDS; bottom: concerted electron and proton transfer (CPET) is rate determining step (RDS). Examinations on how the reaction rate depends on $H_2O$ concentration could help discern which route is more likely.

The present invention discloses a detailed study of the concerted proton electron transfer (CPET) process during first steps of the initial electron and proton transfer in $CO_2$ reduction for electrochemical reduction of $CO_2$. Using Au as a prototypical catalyst platform and by studying the kinetics relatively to $P_{CO2}$ and $[HCO_3^-]$, a previous study observed no apparent dependence of the reaction rate on $[HCO_3^-]$, implying that electron transfer (ET) is the rate determining step, followed by proton transfer (PT) (RDS, FIG. 1). However, similar experiments also reported that apparent dependence of the reaction rate on $[HCO_3^-]$, was attributed to possible fast pre-equilibrium between $CO_2$, $H_2O$ and $HCO_3^-$. The latter results could be interpreted as evidence to support the CPET rather than the ET pathway.

It was observed that on the one hand, as an important proton donor, suppression of $H_2O$ concentration ($[H_2O]$) could greatly limit HER so as to promote carbonaceous product selectivity. On the other hand, as a solvent, $H_2O$ participates in nearly every aspect of the reaction. Thus, the effects of varying $H_2O$ concentration on $CO_2$ electrochemical reduction reactions were studied.

In case of water oxidation, one of the proposed mechanism is referred to as water hydrogen atom abstraction (WHAA). WHAA involves direct water nucleophilic attack, followed by $O_2$ release and regeneration of the catalyst. Another proposed mechanism involves coupling of two metal-oxo intermediates followed by $O_2$ release and is referred to as intramolecular oxygen coupling (IMOC). For certain molecular catalysts, density-functional theory (DFT) calculations predicted that the IMOC pathway dominates at low overpotentials, whereas the WHAA pathway becomes accessible at higher overpotentials. The present invention includes a study on how the relative predominance of the two pathways can be controlled by the ionic strength of the electrolyte. In particular, the present invention includes studies on how the reaction kinetics of electrochemical reactions change as a function of water activity. It was observed that using a water-in-salt electrolyte system disclosed in detail herein it is possible to discern the reaction mechanisms without detailed knowledge of the active centers by altering the water activity.

In embodiments of the present invention, the "water-in-salt" (WiS) electrolyte, in which ultra-high concentrations of salt (e.g., lithium bis(trifluoromethane)sulfonamide or LiTFSI, $LiNO_3$, LiCl, $NaClO_4$, NaOH, KOH, KAc, HCOOK, $NaNO_3$, etc.) is mixed with $H_2O$ (up to 21 m, where m is molality, or mole of salt in 1 kg of $H_2O$) is used for controlling the concentration and activity of water in electrochemical reactions.

Advantageously, the WiS system allows electrochemical reactions in an aqueous system where the water activity is no longer unity. The present invention includes electrochemical reactions such as $CO_2$ reduction and $H_2O$ oxidation in an aqueous solution whose $H_2O$ concentration is no longer constant.

Other benefits of a WiS system include, first, the ability to significantly suppress HER due to the limited supplies of $H_2O$ during a $CO_2$ reduction reaction, so as to promote selectivity toward carbonaceous products such as CO in a milder, near neutral condition. Indeed, selectivity toward CO up to 80% was measured in WiS on planar Au catalyst. This was comparable to values measured on carefully modified Au such as oxide-derived or nanostructured Au catalysts.

Second, the WiS system enables interrogation of the electrokinetics of the system by varying the $H_2O$ concentration. The data provided herein is expected to shed new light onto the mechanistic details of the $CO_2$ electrochemical reduction processes. For example, the electrokinetic analyses disclosed herein revealed that the reaction rate appeared to be independent of $H_2O$ concentration at low overpotentials.

Moreover, the new dimension of the reaction parameters is provided, it also offers a new route to highly selective $CO_2$ reduction for practical applications. In addition, the WiS electrolytes disclosed herein provide for higher activity for water oxidation compared to earlier reported methods that do not use a WiS electrolyte.

It is envisioned that the methods disclosed here using water-in-salt electrolyte will find application in a variety of electrochemical redox reaction schemes for both mechanistic understanding and performance improvement.

In one aspect, this disclosure relates to an electrolyte for an electrochemical reduction of carbon dioxide. In an embodiment, the electrolyte comprises a super concentrated aqueous solution of a salt selected from the group consisting of LiTFSI, LiCl, $NaClO_4$, NaOH, KOH, KAc, HCOOK, and $KClO_4$. Such electrolyte/solution at high concentrations is categorized as "water-in-salt". In an embodiment, the salt is present in the electrolyte at a molality in a range from 15 mole/kg to 21 mole/kg, 16 mole/kg to 20 mole/kg, 17 mole/kg to 19 mole/kg, or 17 mole/kg to 18 mole/kg. In an embodiment, the salt is present in the electrolyte at a molality of 15 mole/kg, 16 mole/kg, 17 mole/kg, 18 mole/kg, 19 mole/kg, 20 mole/kg or 21 mole/kg. In an embodiment, the electrolyte comprises a super concentrated aqueous solution of lithium bis-(trifluoromethanesulfonyl)imide (LiTFSI). In an embodiment, LiTFSI is present in the electrolyte at a molality in a range from 15 mole/kg to 21 mole/kg, 16 mole/kg to 20 mole/kg, 17 mole/kg to 19 mole/kg, or 17 mole/kg to 18 mole/kg, or any range between any two of these values. In an embodiment, LiTFSI is present in the electrolyte at a molality of 15 mole/kg, 16 mole/kg, 17 mole/kg, 18 mole/kg, 19 mole/kg, 20 mole/kg or 21 mole/kg or any molality between any two of these values. In an embodiment, the electrolyte has a pH in a range from 5 to 7 or 5.5-6.5 or any range between any two of these values, as measured by a double-junction pH electrode. In an embodiment, the electrolyte has a pH in at 5, 5.5, 6, 6.5, or 7, or any pH between any two of these values, as measured by a double-junction pH electrode. In an embodiment, water is present in the electrolyte at a concentration in a range from 13 M to 18 M, 14 M to 17 M, 15 M to 16 M, 13 M to 17 M, 13 M to 16 M, 13 M to 15 M, 14 M to 18 M, 14 M to 16 M, 15 M to 18 M, 15 M to 17 M, 16 M to 18 M, or 16 M to 17 M, or any range between any two of these values. In an embodiment, water is present in the electrolyte at a concentration of 13 M, 14 M, 15 M, 16 M, 17 M, or 18 M or any concentration between any two of these values.

In another aspect, this disclosure relates to a flow cell for reducing carbon dioxide, the flow cell comprising:

- a first chamber having a gold coated gas diffusion layer working electrode, a reference electrode, and a water-in-salt electrolyte comprising a super concentrated aqueous solution of lithium bis-(trifluoromethanesulfonyl)imide (LiTFSI);
- a second chamber adjacent the first chamber and having gold coated gas diffusion layer counter electrode and the water-in-salt electrolyte, the second chamber being separated from the first chamber by a proton exchange membrane; and
- a reservoir containing a volume of the water-in-salt electrolyte and a head space, the reservoir being coupled to each of the first and the second chambers with a pump.

In an embodiment, the flow cell has a volume ratio of the water-in-salt electrolyte to the head space in the reservoir in a range from about 3-5, about 3-4, or about 4-5 or any range between any two of these values. In an embodiment, the flow cell has a volume ratio of the water-in-salt electrolyte to the head space in the reservoir selected from the group consisting of about 3, 3.5, 4, 4.5, or 5, or any ratio between any two of these values.

In an embodiment, the flow cell has a reference electrode comprising a lithium-iron-phosphate electrode. In an embodiment, the flow cell has a proton exchange membrane comprising Nafion.

In an embodiment, the flow cell comprises an electrolyte comprising a super concentrated aqueous solution of a salt selected from the group consisting of LiTFSI, $LiNO_3$, LiCl, $NaClO_4$, NaOH, KOH, KAc, HCOOK, $NaNO_3$, $KNO_3$, and $KClO_4$. In an embodiment, the flow cell comprises an electrolyte comprising a super concentrated aqueous solution of lithium bis-(trifluoromethanesulfonyl)imide (LiTFSI). In an embodiment, LiTFSI is present in the electrolyte at a molality in a range from 15 mole/kg to 21 mole/kg, 16 mole/kg to 20 mole/kg, 17 mole/kg to 19 mole/kg, or 17 mole/kg to 18 mole/kg or any range between any two of these values. In an embodiment, LiTFSI is present in the electrolyte at a molality of 15 mole/kg, 16 mole/kg, 17 mole/kg, 18 mole/kg, 19 mole/kg, 20 mole/kg or 21 mole/kg, or any molality between any two of these values. In an embodiment, the electrolyte has a pH in a range from 5 to 7 or 5.5-6.5 as measured by a double-junction pH electrode. In an embodiment, the electrolyte has a pH in at 5, 5.5, 6, 6.5, or 7 as measured by a double-junction pH electrode. In an embodiment, water is present in the electrolyte at a concentration in a range from 13 M to 18 M, 14 M to 17 M, 15 M to 16 M, 13 M to 17 M, 13 M to 16 M, 13 M to 15 M, 14 M to 18 M, 14 M to 16 M, 15 M to 18 M, 15 M to 17 M, 16 M to 18 M, or 16 M to 17 M, or any range between any two of these values. In an embodiment, water is present in the electrolyte at a concentration of 13 M, 14 M, 15 M, 16 M, 17 M, or 18 M, or any concentration between any two of these values.

In an embodiment, the water-in-salt electrolyte from both the first and the second chambers is saturated with carbon dioxide.

In yet another aspect, the disclosure relates to a method of reducing carbon dioxide to carbon monoxide, the method comprises:

saturating the water-in-salt electrolyte in a flow cell with carbon dioxide; and applying a potential across a working electrode and a counter electrode of the flow cell, wherein the flow cell comprises a first chamber having a gold coated gas diffusion layer as the working electrode, a reference electrode, and a water-in-salt electrolyte comprising a super concentrated aqueous solution of lithium bis-(trifluoromethanesulfonyl)imide (LiTFSI), a second chamber adjacent the first chamber and having gold coated gas diffusion layer as the counter electrode and the water-in-salt electrolyte, the second chamber being separated from the first chamber by a proton exchange membrane, and a reservoir containing a volume of the water-in-salt electrolyte and a head space, the reservoir being coupled to each of the first and the second chambers with a pump.

In an embodiment, the potential applied to the working electrode is in a range from about −0.8 V to about −0.3 V, −0.7 V to about −0.3 V, −0.6 V to about −0.3 V, −0.5 V to about −0.3 V, −0.4 V to about −0.3 V, −0.7 V to about −0.2 V, −0.6 V to about −0.1 V, or −0.5 V to about −0.1 V, or any range between any two of these values, measured relative to a reversible hydrogen electrode.

In an embodiment, the potential applied across the working electrode and the counter electrode is in a range from about −0.8 V, about −0.7 V, about −0.6 V, about −0.5 V, about −0.4 V, about −0.3 V, about −0.2 V, or about −0.1 V, measured relative to a reversible hydrogen electrode.

In an embodiment, partial pressure of carbon dioxide in each of the first and second chambers of the flow cell is in a range from about 0.2 atm to about 1 atm, about 0.3 atm to about 1 atm, about 0.4 atm to about 1 atm, about 0.5 atm to about 1 atm, about 0.6 atm to about 1 atm, about 0.7 atm to about 1 atm, about 0.8 atm to about 1 atm, or about 0.9 atm to about 1 atm or any range between any two of these values. In an embodiment, partial pressure of carbon dioxide in each of the first and second chambers of the flow cell is about 0 atm, about 0.1 atm, about 0.2 atm, about 0.3 atm, about 0.4 atm, about 0.5 atm, about 0.6 atm, about 0.7 atm, about 0.8 atm, about 0.9 atm, or about 1.0 atm or any pressure between any two of these values.

In an embodiment, the method described herein further comprises measuring a selectivity ratio of partial current density due to carbon monoxide to partial current density due to carbon monoxide and partial current density due to hydrogen; and adjusting one or both of a partial pressure of carbon dioxide in the water-in-salt electrolyte and the applied potential so as to maximize selectivity ratio.

In an embodiment, the electrolyte comprises a super concentrated aqueous solution of lithium bis-(trifluoromethanesulfonyl)imide (LiTFSI). In an embodiment, LiTFSI is present in the electrolyte at a molality in a range from 15 mole/kg to 21 mole/kg, 16 mole/kg to 20 mole/kg, 17 mole/kg to 19 mole/kg, or 17 mole/kg to 18 mole/kg, or any range between any two of these values. In an embodiment, LiTFSI is present in the electrolyte at a molality of 15 mole/kg, 16 mole/kg, 17 mole/kg, 18 mole/kg, 19 mole/kg, 20 mole/kg or 21 mole/kg, or any molality between any two of these values. In an embodiment, the electrolyte has a pH in a range from 5 to 7 or 5.5-6.5, or any range between any two of these values, as measured by a double-junction pH electrode. In an embodiment, the electrolyte has a pH in at 5, 5.5, 6, 6.5, or 7, or any pH between any two of these values as measured by a double-junction pH electrode. In an embodiment, water is present in the electrolyte at a concentration in a range from 13 M to 18 M, 14 M to 17 M, 15 M to 16 M, 13 M to 17 M, 13 M to 16 M, 13 M to 15 M, 14 M to 18 M, 14 M to 16 M, 15 M to 18 M, 15 M to 17 M, 16 M to 18 M, or 16 M to 17 M, or any range between any two of these ranges. In an embodiment, water is present in the electrolyte at a concentration of 13 M, 14 M, 15 M, 16 M, 17 M, or 18 M, or any concentration between any two of these values.

In an embodiment, the reference electrode comprises a lithium-iron-phosphate electrode.

In yet another aspect, the disclosure relates to a method of controlling a rate of electrochemical water oxidation reaction, the method comprising:

providing super concentrated aqueous solution of a salt to form a water-in-salt system as an electrolyte for the electrochemical reaction on a cobalt oxide-based electrocatalyst substrate; and varying a concentration of water in the water-in-salt system during the electrochemical water oxidation.

In an embodiment, the cobalt oxide-based electrocatalyst comprises CoOOH.

In an embodiment, varying the concentration of water comprises varying the amount of the salt included in the water-in-salt system so as to change an activity of water.

In an embodiment, the salt is selected from the group consisting of $NaNO_3$, $KNO_3$, $NaClO_4$, and $KClO_4$.

EXAMPLES

The following examples are provided to illustrate embodiments of the present invention but are by no means intended to limit its scope.

The examples described herein will be understood by one of ordinary skill in the art as exemplary protocols. One of ordinary skill in the art will be able to modify the below procedures appropriately and as necessary.

Electrochemical Reduction of Carbon Dioxide

Starting Materials

LiTFSI was obtained from Solvay (≥99.9%, extra dry) and Sigma-Aldrich (≥99.95%, trace metals basis). $NaHCO_3$ was purchased from Sigma-Aldrich (≥99.7%). Deionized water (DI, 18.2 MΩ·cm) was obtained from a Barnstead Nanopure Diamond system. The water-in-salt electrolyte (WiS) was prepared by dissolving 21 m (21 mole/1 kg) LiTFSI into DI $H_2O$, then gradually diluted to 18 m (18 mole/1 kg) and 15 m (15 mole/1 kg). The $NaHCO_3$ electrolyte was prepared by dissolving 0.5 M $NaHCO_3$ into DI $H_2O$. The planar Au foil (99.95%, polycrystalline, 0.25 mm thick) was obtained from Alfa Aesar. The Au target (>99.9%) for sputtering was purchased from Kurt J. Lesker. Gas diffusion layer (GDL, Freudenberg H14 and Freudenberg H24C5) was purchased from the Fuel Cell Store. The LFP (MTI Corp) films were cut into rectangular pieces with an area of ca. 0.5 $cm^2$ as pseudo reference electrode to be used in WiS electrolytes. The detailed procedure to prepare LFP as pseudo reference electrode is described in our previous study. $CO_2$ (ultra-high purity), 5% $H_2$ in $N_2$ (ultra-high purity), 5% CO in Ar (ultra-high purity), and Ar (ultra-high purity) gases were obtained from Airgas.

Preparation of Au Electrode

Au foil electrode: The planar Au foil was used as the catalyst without additional modification or structural treatment, so as to maintain a planar surface structure for consistent current density measurement. The Au foil was connected with electrical contact wrapped by inert organic sealing materials. Before electrochemical measurements, the electrode was cleaned by aqua regia for 20 s, followed by a thorough wash in DI water. Before electrochemical measurements, all Au foil electrodes were washed with acetone, methanol and isopropanol consecutively, then dried at 60° C. under vacuum to remove surface adsorbed moisture. The sealing materials were completely isolated from the electrolyte to avoid any possible contamination. It was found that the Au foil without aqua regia treatment may result in less desired electrode performance such as lower current densities and lower Faradaic efficiency. The cleaning process was therefore repeated every time before each experiment to maintain a good and consistent foil quality.

Sputtered Au electrode: The sputtered Au catalyst with morphology featuring conformal flat film were prepared by radio frequency magnetron sputtering technique using AJA system which was set up in a cleanroom. An Au target was used as the source to prepare Au catalyst coated electrodes. The target was placed in ultra-high vacuum chamber with 250 W Ar plasma supported by direct current at 512 V and 490 mA. The sputtering growth rate was calibrated to be ca. 0.6 nm/s. Au films were prepared on p (111) Si wafer and GDL electrode, which were used in electrochemical cell and flow cell respectively. Before electrochemical measurements, all sputtered Au coated electrodes were washed with acetone, methanol and isopropanol consecutively, then dried at 60° C. under vacuum to remove moisture. The substrates loaded with Au catalyst were wrapped with sealing material which was completely isolated from the electrolyte to avoid any contamination. Note that it is not desired to use aqua regia to clean the sputtered electrodes (20 s etching will lead to significant loss of Au). The lack of etching process may have resulted in the relatively poor activity.

Cell Configurations and Setups

Figure 3:
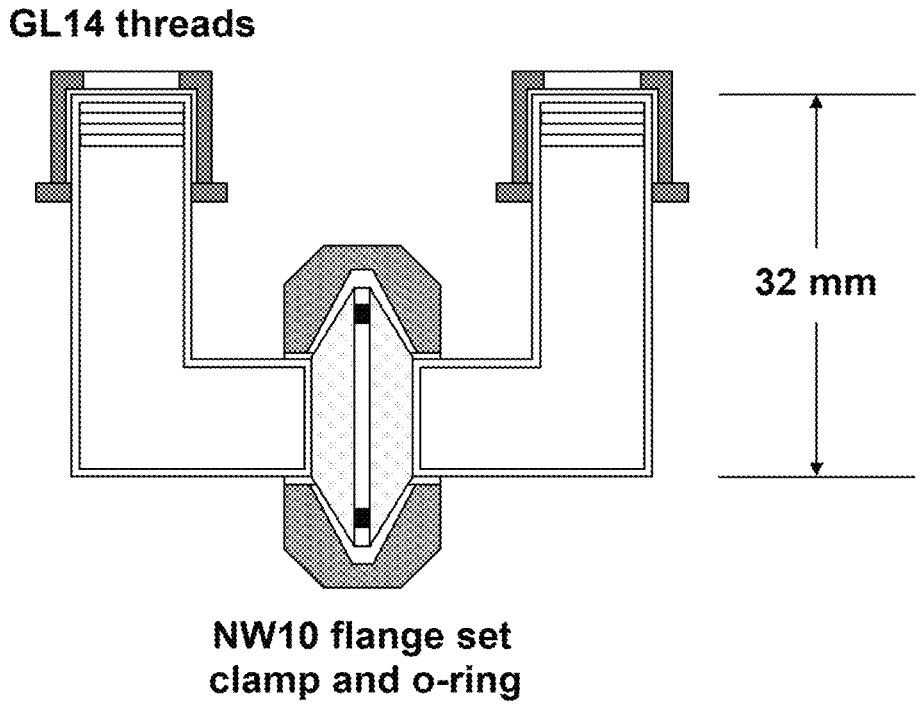
FIG. 3 shows a schematic drawing of the home-designed H-cell used for electrochemical measurements. Each cylindrical chamber maybe tilted during manufacturing to ensure clearance between the flange and the threads.

Electrochemical H-cell: A proprietary two-chamber electrochemical H-cell as shown in FIG. 3 was used for CV measurements as well as a portion of potentiostatic electrolysis. The volume of the cell and the size of head space were optimized to obtain desired accuracy for product detection via injection method by GC-MS. A proton exchange membrane (Nafion 211 or Nafion 117) was used to separate the two chambers, which is compatible with WiS. Either a planar Au foil or a sputtered Au film as working electrode and a LFP as reference electrode were place in the cathodic chamber while another Au electrode was placed in the anodic chamber as counter. The headspaces in the two chambers were filled with either Ar or $CO_2$ atmosphere, then sealed by Teflon coated rubber septa and GL 14 caps. Additional vacuum grease may be applied, as necessary, to further ensure the sealing for accurate gaseous product detection.

Figure 13:
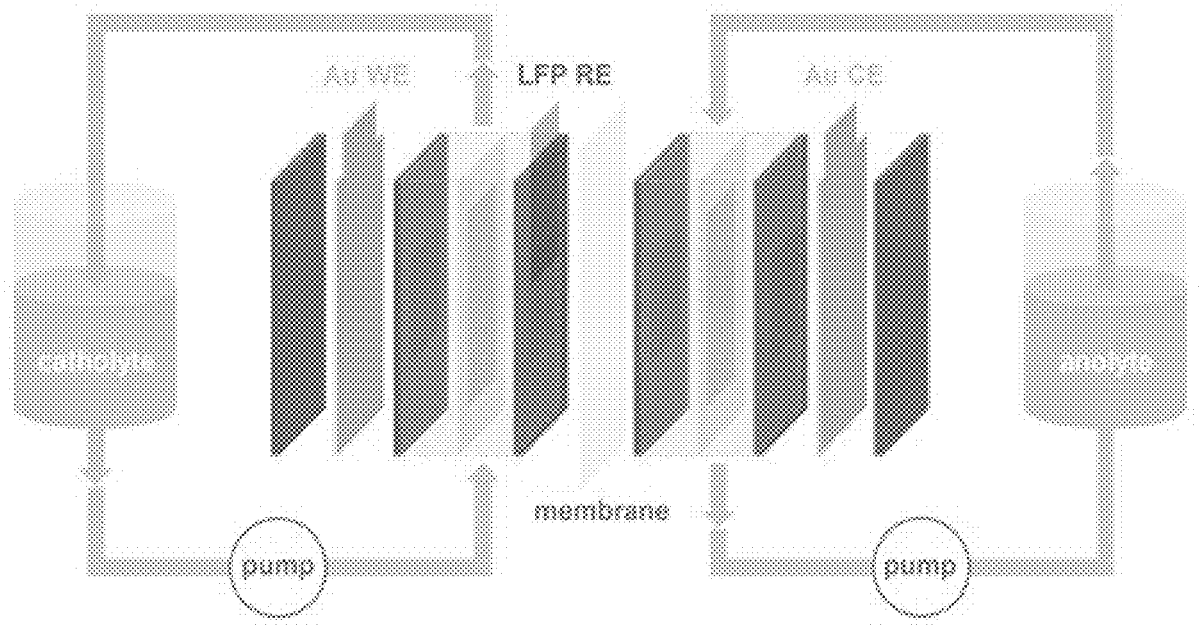
FIG. 13 shows schematic drawing of a commercially available flow cell for electrochemical measurements. Two pieces of sputtered Au coated GDL electrodes were used as working electrode (WE) and counter electrode (CE) respectively. A pre-delithiated LFP film was used as reference electrode (RE) which is inserted and sealed with a gasket. A Nafion film was used as membrane to separate the cathodic chamber and the anodic chamber. Two reservoirs with electrolyte volume of ca. 8 mL and head space of ca. 2 mL were paired with a peristaltic pump.

Flow cell: A flow cell as shown in FIG. 13 was used for a portion of the potentiostatic electrolysis measurement. The flow cell contains two chambers divided by flow frames and several Viton rubber gaskets. A proton exchange membrane (Nafion 211 or Nafion 117) was used to separate the electrolytes of two chambers due to their compatibility with WiS. A sputtered Au coated GDL working electrode and a LFP reference electrode were place in the cathodic chamber while another Au coated counter electrode was placed in the anodic chamber. The electrolyte in each chamber circulates through a separate reservoir with an optimized electrolyte volume (ca. 8 mL) and size of head space (ca. 2 mL). The flow rate was controlled to be ca. 15-20 mL/min. In this region, no observable variation was detected due to the fluctuation of the flow speed.

Electrochemical Measurements

Before electrochemical measurements, either Ar or $CO_2$ or an Ar/$CO_2$ mixture controlled by mass flow controllers was used to purge the head space (maintaining at 1 atm) and was bubbled through the electrolyte slowly to reach a saturated state. This procedure in WiS electrolyte is carried out carefully with relatively low purging rate (<10 sccm), to prevent precipitation of the supporting salt or side reactions may occur.

In this study, the electrochemical potential calibration to the reverse hydrogen electrode (RHE) scale was carried out using a double junction pH electrode (Thermo Scientific). Inaccurate pH measurements can be obtained by using a conventional single junction pH electrode due to the presence of highly concentrated Li salt (see FIG. 9). The high $Li^+$ concentration was found to shift the reference electrode in the conventional single junction pH meter.

CV measurements were conducted using the proprietary two-chamber electrochemical H-cell. The scan rate was set as 25 mV/s starting from open circuit potential to more cathodic potentials, then scanned backwards. WiS electrolytes were purged with either Ar or $CO_2$. Control experiments were carried out using 0.5 M $NaHCO_3$ electrolyte saturated with $CO_2$. No significantly different electrochemical features can be observed using either Au foil or sputtered Au film electrodes under CV testing conditions, despite with slightly different current densities.

Figure 2:
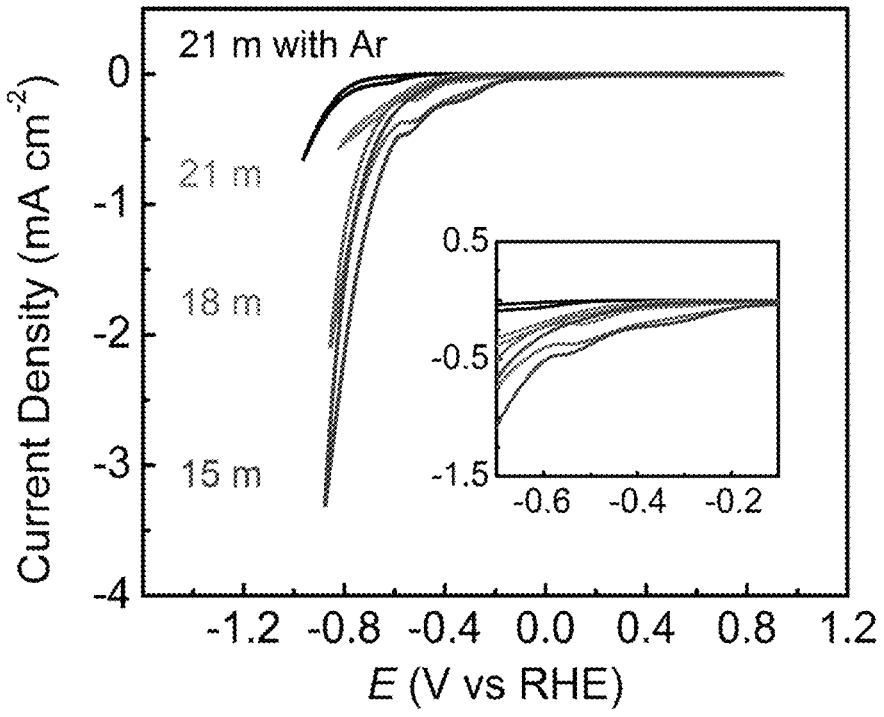
FIG. 2 shows the cyclic voltammograms of Au catalyst in WiS of different concentrations, the WiS electrolytes are saturated with either Ar or $CO_2$.

Potentiostatic electrolysis experiments were conducted with both electrochemical H-cell and flow cell. Before each electrolysis, a CV scan was conducted to ensure the good quality of the Au electrode where consistent features as shown in FIG. 2 are generally observed. Cutoff capacities at 0.1 C and 10 C were used for electrochemical cell and flow cell respectively to detect gaseous product. Larger applied capacities may lead to gradual loss of catalytic activity or the depletion of $CO_2$. CO selectivity was calculated according to the following equation by assuming other products other than CO and $H_2$ are negligible: $N_{CO}/(N_{CO}+N_{H2})$. After completion to the cutoff capacity upon electrolysis, gaseous products were sampled from the head space and analyzed by GC-MS. At least two consecutive trials were taken within 0.5 h to the injection port to ensure reproducibility. Prolonged waiting time may result in gas leakage.

The electrochemical H-cell was used for electrokinetic studies, where a smaller capacity cutoff may be applied so as to maintain the good quality of the Au foil or sputtered Au film, since the electrolysis is highly preferred to be conducted with comparable electrode condition to minimize sample variations. Note that for the sputtered Au, sample variations were large due to the uneven sputtering positions from the target to the substrate (sample holder), resulting in variations in the film quality. Therefore, it is desired to carry out electrokinetic studies at low overpotentials using planar Au foils where more accurate current density measurement can be achieved. Note that at high overpotentials, however, stable current densities were only measurable using the sputtered Au catalyst but not on the planar Au foils due to its quick loss of catalytic activity. Control experiments on electrolysis were carried out using 0.5 M $NaHCO_3$ electrolyte saturated with $CO_2$ in electrochemical H-cell.

Material Characterization

X-ray photoelectron spectroscopy (XPS) was carried out on a K-Alpha+ XPS (Thermo Scientific) with an Al X-ray source (incident photon energy 1486.7 eV). Scanning electron microscopy (SEM) was conducted using a JEOL 6340F microscope operated at a 10 kV accelerating voltage. $^1H$ NMR was performed on a 600 MHz spectrometer with the suppression of $H_2O$. The electrolytes upon electrolysis were collected in $D_2O$ to detect liquid products and byproducts. All 1H NMR chemical shifts were reported in ppm relative to a residual HDO peak at 4.78 ppm (TSP at 0 ppm). The small peak (at ca. 2 ppm) shown in NMR spectra corresponds to the impurity from LiTFSI which was not found to influence the data analyses. Gas chromatograph mass spectrometer (GC-MS) analyses were performed using a Shimadzu QP2010 Ultra instrument, with a Carboxen 1010 PLOT column. The CO and $H_2$ calibration curves were collected by manually injecting known amounts of standard gases through the injection port of GC-MS.

Mathematical Derivation of Rate Laws.

The results are summarized in Table 3. Note in the following derivation, B is the transfer coefficient, F is Faraday constant, E is the applied potential, R is the ideal gas constant, a is the activity of a referred species, θ is the surface coverage of a referred species, K is the equilibrium constant of a reaction. Due to the difficulty in measuring the activity coefficient of various species, the electrokinetic studies were mainly conducted by using "concentration" to substitute "activity". Controlling a constant activity or concentration of dissolved $CO_2$ is challenging, which was attempted by fixing the partial pressure of $CO_2$ in the gas phase/head space, similar to what has been done by previous studies.

If A1 is the rate determining step (RDS):

$$v_{co} = \theta_M a_{CO_2} \exp\left(-\frac{\beta FE}{RT}\right) \tag{1}$$

If A2 is the RDS:

$$v_{co} = \theta_{MCOO} - \alpha_{H_2O} \tag{2}$$

$$K_{A1} \exp\left(-\frac{FE}{RT}\right) = \frac{\theta_{MCOO^-}}{\theta_M \cdot a_{CO_2}} \tag{3}$$

From (2), (3):

$$v_{co} = K_{A1} \theta_M a_{CO_2} a_{H_2O} \exp\left(-\frac{FE}{RT}\right) \tag{4}$$

If A3 is the RDS:

$$v_{co} = \theta_{MCOOH} a_{H_2O} \exp\left(-\frac{\beta FE}{RT}\right) \tag{5}$$

$$K_{A2} = \frac{a_{OH^-} \cdot \theta_{MCOOH}}{\theta_{MCOO^-} \cdot a_{H_2O}} \tag{6}$$

$$K_{A1} \exp\left(-\frac{FE}{RT}\right) = \frac{\theta_{MCOO^-}}{\theta_M \cdot a_{CO_2}} \tag{7}$$

From (5), (6), (7):

$$v_{co} = K_{A1} K_{A2} \theta_M a_{CO_2} a_{H_2O}^2 a_{OH}^{-1} - \exp\left[-\frac{(1+\beta)FE}{RT}\right] \tag{8}$$

If B1 is the RDS:

$$v_{co} = \theta_M a_{CO_2} a_{H_2O} \exp\left(-\frac{\beta FE}{RT}\right) \tag{9}$$

If B2 is the RDS:

$$v_{co} = \theta_{MCOOH} a_{H_2O} \exp\left(-\frac{\beta FE}{RT}\right) \tag{10}$$

$$K_{B1} \exp\left(-\frac{FE}{RT}\right) = \frac{a_{OH^-} \cdot \theta_{MCOOH}}{\theta_M \cdot a_{CO_2} \cdot a_{H_2O}} \tag{11}$$

From (10), (11):

$$v_{co} = K_{B1} \theta_M a_{CO_2} a_{H_2O}^2 a_{OH}^{-1} - \exp\left[-\frac{(1+\beta)FE}{RT}\right] \tag{12}$$

If C1 is the RDS:

$$v_{co} = \alpha_{CO_2} \alpha_{H_2O} \alpha_{HCO_3^-} \tag{13}$$

$$HCO_3^- + H^+ = H_2CO_3 \quad K_{acid} = \frac{a_{H_2CO_3}}{a_{H^+} \cdot a_{HCO_3^-}} \tag{14}$$

$$CO_2 + H_2O = H_2CO_3 \quad K = \frac{a_{H_2CO_3}}{a_{CO_2} \cdot a_{H_2O}} \tag{15}$$

From (13), (14), (15):

$$v_{co} = K_{acid} K \alpha_{CO_2}{}^2 \alpha_{H_2O}{}^2 \alpha_{H^+}{}^{-1} \tag{16}$$

or $$v_{co} = K_{acid} K K_w{}^{-1} \alpha_{CO_2}{}^2 \alpha_{H_2O}{}^2 \alpha_{OH^-} \tag{17}$$

If C2 is the RDS:

$$v_{co} = \theta_M [Int^-] a_{H_2O} \exp\left(-\frac{\beta FE}{RT}\right) \tag{18}$$

-continued $$K_{C1} = \frac{[Int^-]}{a_{CO_2} \cdot a_{H_2O} \cdot a_{HCO_3^-}} \quad (19)$$

From (18), (19):

$$v_{co} = K_{acid} K K_{C1} \theta_M a_{CO_2}^2 a_{H_2O}^3 a_{H^+}^{-1} \exp\left(-\frac{\beta FE}{RT}\right) \quad (20)$$

or $$v_{co} = K_{acid} K K_{C1} K_w^{-1} \theta_M a_{CO_2}^2 a_{H_2O}^3 a_{OH} - \exp\left(-\frac{\beta FE}{RT}\right) \quad (21)$$

If C3 is the RDS:

$$v_{co} = \theta_{MCOOH} a_{H_2O} \exp\left(-\frac{\beta FE}{RT}\right) \quad (22)$$

$$K_{C2} \exp\left(-\frac{FE}{RT}\right) = \frac{\theta_{MCOOH} \cdot a_{H_2O} \cdot a_{HCO_3^-} \cdot a_{OH^-}}{\theta_M \cdot [Int^-] \cdot a_{H_2O}} \quad (23)$$

From (19), (22), (23):

$$v_{co} = K_{C1} K_{C2} \theta_M a_{CO_2} a_{H_2O}^2 a_{OH}^{-1} - \exp\left[-\frac{(1+\beta)FE}{RT}\right] \quad (24)$$

If D1 is the RDS:

$$v_{co} = \theta_M a_{CO_2} \exp\left(-\frac{\beta FE}{RT}\right) \quad (25)$$

If D2 is the RDS:

$$v_{co} = \theta_M a_{H_2O} \exp\left(-\frac{\beta FE}{RT}\right) \quad (26)$$

If D3 is the RDS:

$$v_{co} = \theta_{MCOO^-} - \theta_{MH} \alpha_{H_2O} \quad (27)$$

$$K_{D1} \exp\left(-\frac{FE}{RT}\right) = \frac{\theta_{MCOO^-}}{\theta_M \cdot a_{CO_2}} \quad (28)$$

$$K_{D2} \exp\left(-\frac{FE}{RT}\right) = \frac{a_{OH^-} \cdot \theta_{MH}}{\theta_M \cdot a_{H_2O}} \quad (29)$$

From (27), (28), (29):

$$v_{co} = K_{D1} K_{D2} \theta_M^2 a_{CO_2} a_{H_2O}^2 a_{OH}^{-1} - \exp\left(-\frac{2FE}{RT}\right) \quad (30)$$

If HER is the RDS:

$$v_{H_2} = \theta_M a_{H_2O} \exp\left(-\frac{\beta FE}{RT}\right) \quad (31)$$

If HER1 is the RDS:

$$v_{H_2} = \theta_{MH}^2 \quad (32)$$

$$K_{HER} \exp\left(-\frac{FE}{RT}\right) = \frac{a_{OH^-} \cdot \theta_{MH}}{\theta_M \cdot a_{H_2O}} \quad (33)$$

From (32), (33):

$$v_{H_2} = K_{HER}^2 \theta_M^2 a_{H_2O}^2 a_{OH}^{-2} - \exp\left(-\frac{2FE}{RT}\right) \quad (34)$$

If HER2 is the RDS:

$$v_{H_2} = \theta_{MH} a_{H_2O} \exp\left(-\frac{\beta FE}{RT}\right) \quad (35)$$

From (33), (35):

$$v_{H_2} = K_{HER} \theta_M a_{H_2O}^2 a_{OH}^{-1} - \exp\left[-\frac{(1+\beta)FE}{RT}\right] \quad (36)$$

Results

Au was selected as a model catalyst because it features high selectivity towards CO production as opposed to other carbonaceous products. For instance, it has been reported that under common experimental conditions, the cathodic currents on Au electrode mainly constitute that of CO and $H_2$ production. As such, it is convenient to interpret the electrochemical data for kinetic analyses of the elemental steps during $CO_2$ electrochemical reduction. Another reason for choosing Au is the broad knowledge on Au-based $CO_2$ reduction, which allows for an easy comparison of results from the present invention with the literature. However, the present invention is not limited thereto, and those of ordinary skill in the art upon understanding the details of the present invention will be able to suitably modify the details disclosed herein for use with other catalysts.

Figure 4:
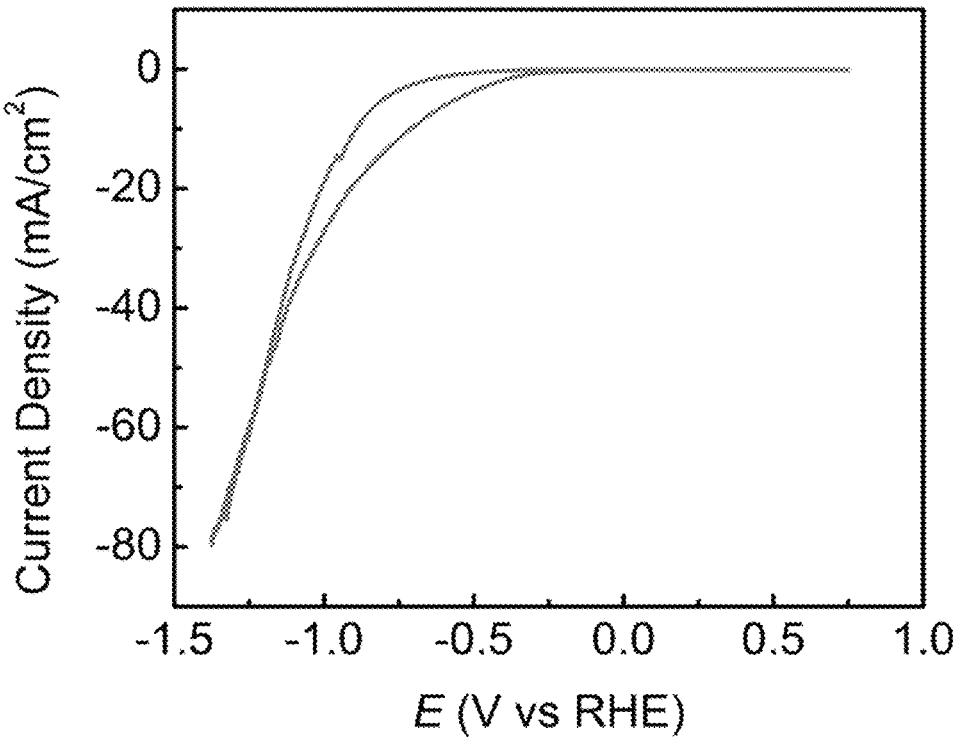
FIG. 4 shows a typical cyclic voltammogram (CV) of Au catalyst in $CO_2$ saturated 0.5 M $NaHCO_3$ electrolyte.

As shown in FIG. 2, a prominent feature of the cyclic voltammogram (CV) in different electrolytes was the suppression of the cathodic currents with the gradual increase of salt concentration from 15 m to 21 m (the home-designed electrochemical cell is shown in FIG. 3). It is hypothesized that the suppression is due to limited hydrogen evolution as a result of decrease in $H_2O$ concentration, more discussions of which will be presented in the next section. Here, it will be appreciated that the reduction features as magnified in the inset of FIG. 2 (the conversion of potentials using a calibrated pseudo reference electrode is listed in Table 1). The cathodic peaks, which are likely due to $CO_2$ reduction reactions, remained at ca. −0.52 V (vs. reversible hydrogen electrode, RHE; unless noted, all potentials henceforth are relative to RHE) for different salt concentrations. The onset potentials at which $CO_2$ was reduced are consistent with literature reports on various Au catalysts. It is also consistent with that measured in 0.5 M $NaHCO_3$ electrolyte (FIG. 4).

Moreover, substitution of $CO_2$ with Ar eliminated these features, strongly supporting that these reduction peaks are indeed due to $CO_2$ electrochemical reduction. It is noteworthy that, other than at the highly negative potentials (e.g., <−0.9 V), the combined Faradaic efficiencies of CO plus $H_2$ were consistently measured to be >90%. Additional control experiments confirmed that the WiS electrolyte was not decomposed under the experimental conditions (vide infra). Taken as a whole, the WiS system is a reliable platform which offers electrochemical features of $CO_2$ reduction by Au similar to other electrolyte systems.

TABLE 1

Electrochemical potential conversion for WiS of different concentrations.

| LiTFSI conc. | pH with sat. $CO_2$* | LFP vs $Li^+/Li$ | LFP vs NHE | RHE vs NHE |
|---|---|---|---|---|
| 21 m | 5.7 | 3.68 V | 0.64 V | −0.34 V |
| 18 m | 5.5 | 3.66 V | 0.62 V | −0.33 V |
| 15 m | 5.5 | 3.64 V | 0.60 V | −0.33 V |

*The pH values were measured using a double junction pH electrode to avoid complications by the high concentration of Li salt in WiS electrolytes.

Figure 5:
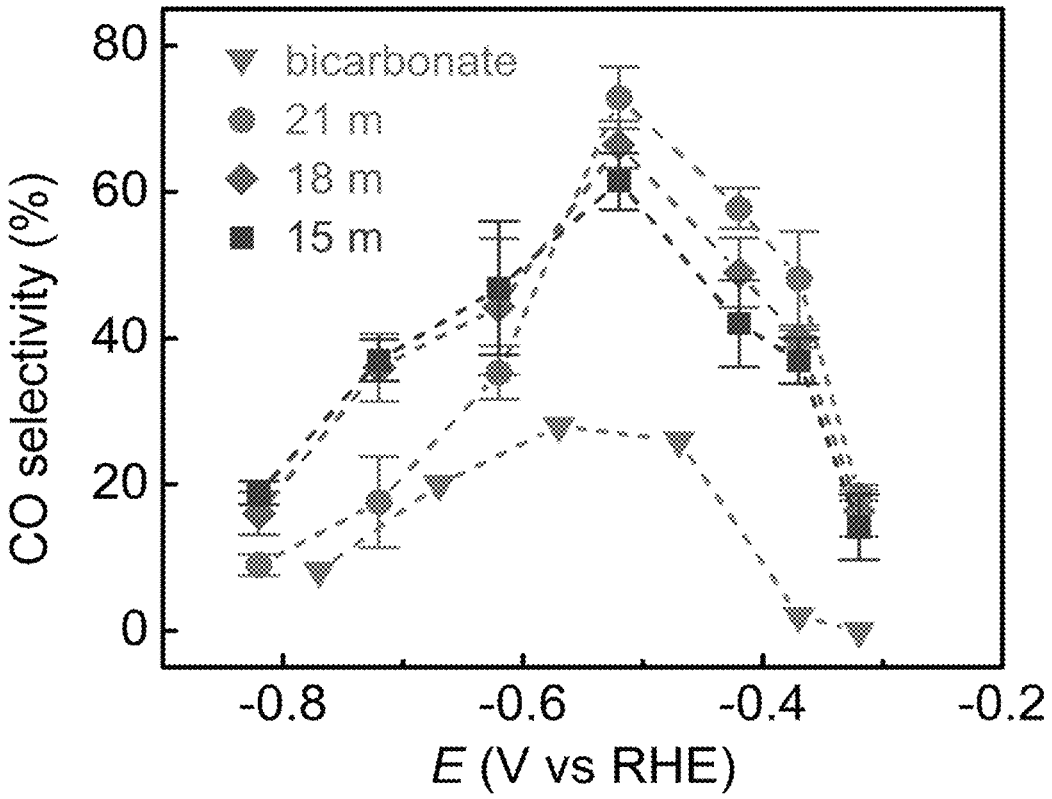
FIG. 5 shows the CO selectivity measured in WiS of different concentrations as well as in 0.5 M $NaHCO_3$ electrolyte. All electrolytes were saturated with $CO_2$.
Figures 6A, 6B:
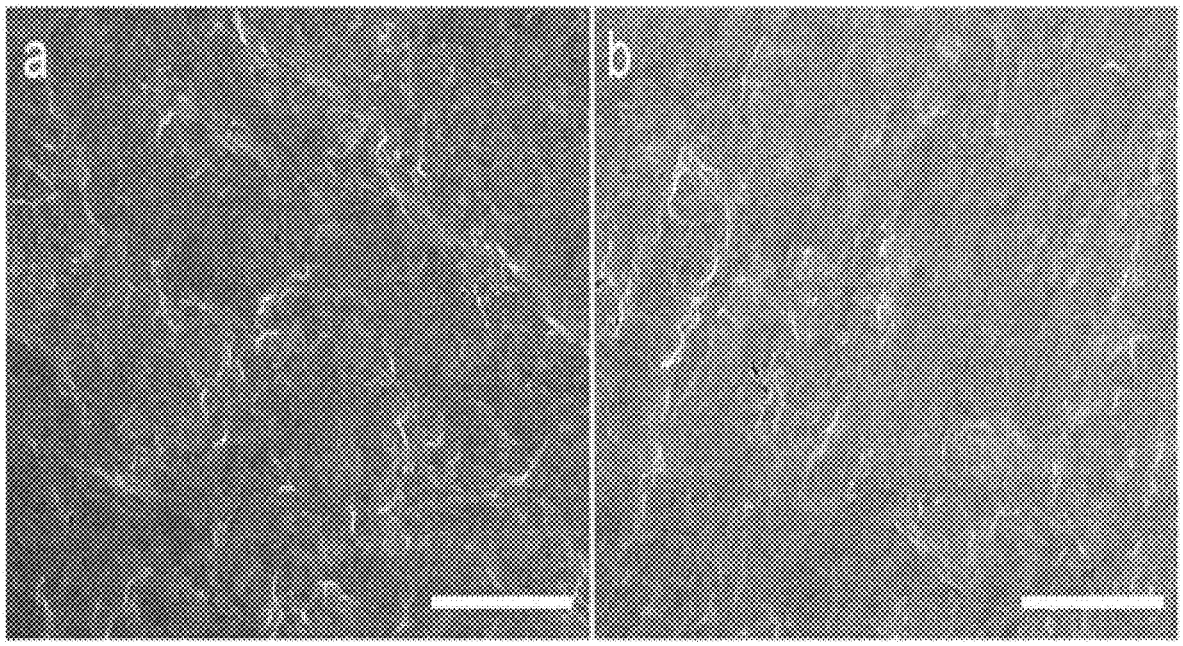
FIG. 6A-6B shows the SEM images of the Au foil catalyst before (A) and after (B) electrolysis. Scale bar: 10 μm. As can be seen in the SEM images, the Au foil exhibits relatively flat surface with negligible micro- or nano-structures before and after electrolysis. Upon electrolysis, the morphology of the Au catalyst remains unchanged.
Figure 7A:
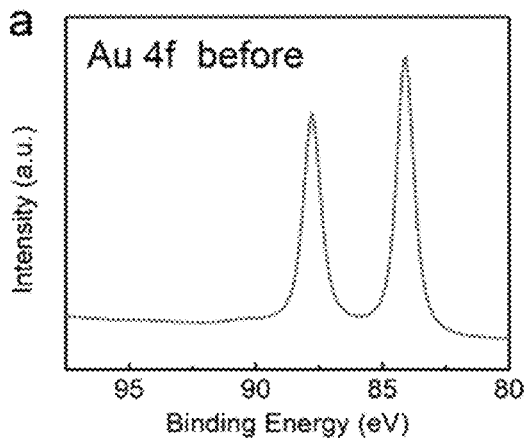
FIG. 7A-7D shows the XPS analysis on the Au foil catalyst. (A) Au 4f spectrum of the Au foil catalyst before electrolysis. (B) F 1s spectrum of the Au foil catalyst before electrolysis. (C) Au 4f spectrum of the Au foil catalyst after electrolysis. (D) F 1s spectrum of the Au foil catalyst after electrolysis. The Au foil electrode/catalyst remained as metallic before and after electrolysis with minimal residues or fluorinated species, indicating that the Au foil electrode/catalyst was stable during $CO_2$ electrochemical reduction in WiS electrolytes.
Figure 7B:
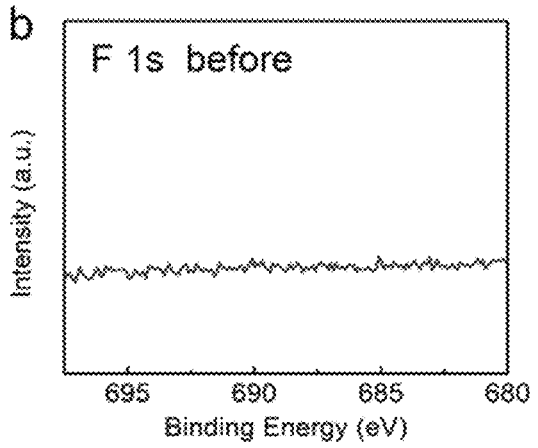
Figure 7C:
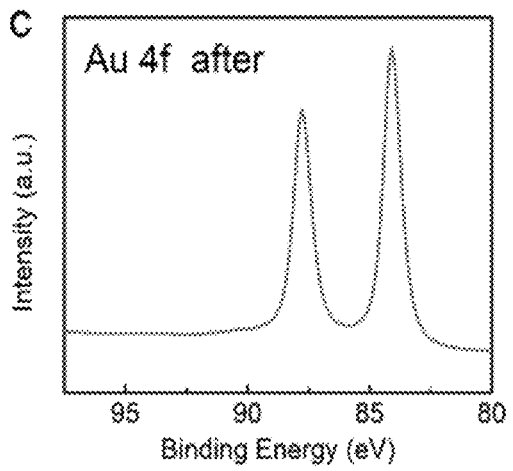
Figure 7D:
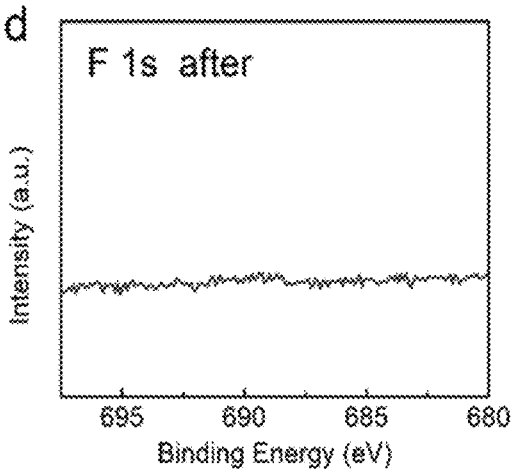
Figure 8:
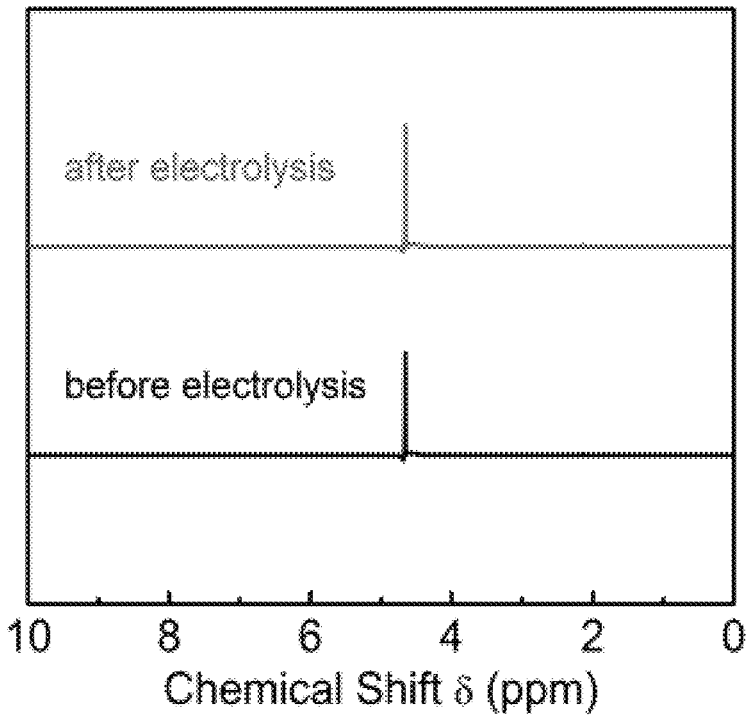
FIG. 8 shows the enlarged $^1H$ NMR spectra of the 21 m WiS electrolyte before (bottom, black trace) and after (top, red trace) electrolysis using Au foil catalyst in an H-cell. The peaks around 2 ppm correspond to the original impurity in LiTFSI. No carbonaceous liquid product was detected upon electrolysis.
Figure 9:
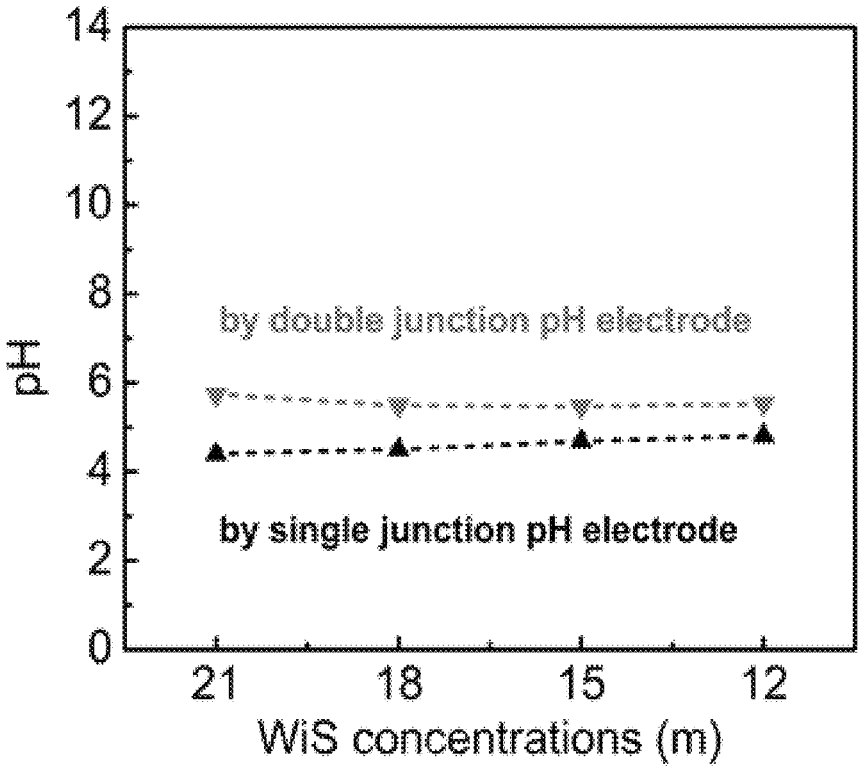
FIG. 9 shows the pH values measured by a conventional single junction pH electrode (black triangle) and by a double junction pH electrode (red triangle) in WiS of different concentrations.

Next, it was aimed to delineate the main contributions to the cathodic current by performing potentiostatic electrolysis and product analyses. The percentage of CO production relative to the overall yield (CO plus $H_2$) was plotted against the applied potentials (FIG. 5). No liquid product or decomposition of electrode and electrolyte were observed upon electrolysis (FIG. 6-8). One sees from this set of data that the maximum selectivity toward CO on planar Au catalyst in $CO_2$-saturated 0.5 M $NaHCO_3$ electrolyte (pH 7.2) was relatively poor, lower than 30%, which would serve as a basis for the following comparisons. Similarly low selectivity has been reported on Au without special treatments. When WiS was used, however, the maximum selectivity was readily increased to up to ca. 72% in 21 m WiS. The performance is close to the best reported in the literature. Most notably, the high selectivity was achieved at near neutral pH of the electrolyte (measured using a double-junction pH electrode as shown in FIG. 9) and on Au catalyst without special treatments.

Figure 10A:
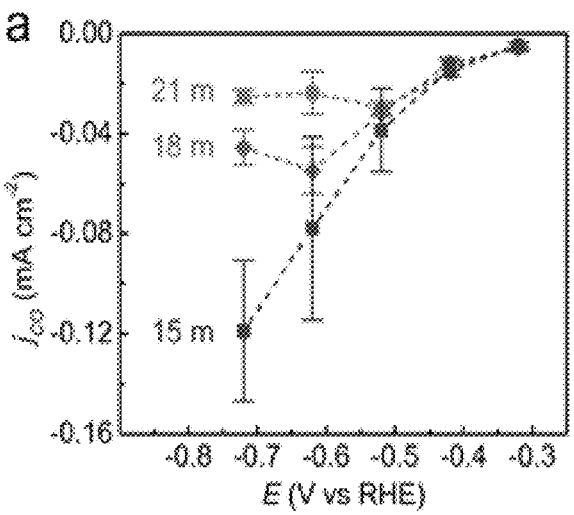
FIG. 10A-10B shows the electrokinetic studies using sputtered Au catalyst. (A) Partial current densities due to CO formation in WiS of different concentrations. (B) Partial current densities due to $H_2$ formation in WiS of different concentrations. Using a less active but more stable sputtered Au catalyst, the partial current densities of CO and $H_2$ can be measured in a relatively broader range of overpotentials (with stable current plateaus). $H_2$ evolution was suppressed with the decrease of $H_2O$ concentration under the most overpotentials studied. $CO_2$ is relatively more limited by mass transport in comparison to that of $H_2O$ at the high overpotential region.
Figure 10B:
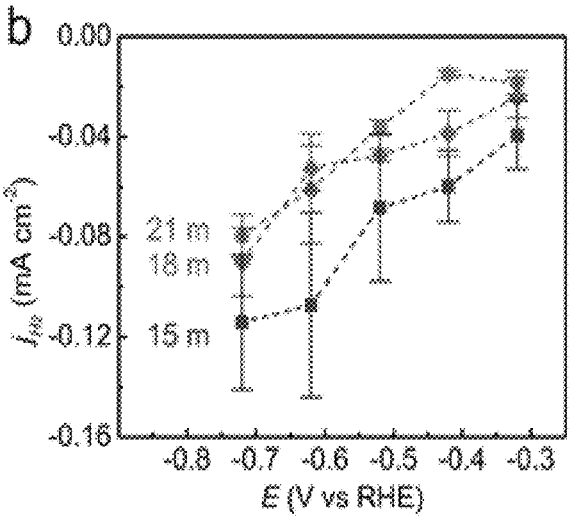

The second feature in FIG. 5 worth highlighting relates to the trend of selectivity as measured against the applied overpotentials. At high overpotentials (e.g., <−0.52 V), the reaction is believed to be mass-transport limited, where relatively low solubility of $CO_2$ and its poor diffusivity greatly limit CO production in comparison to HER; at low overpotentials (e.g., >−0.52 V), the reaction is believed to be more kinetically controlled, in which region higher applied overpotential leads to increased CO production rates. In other words, the low selectivity of CO at high overpotentials is mainly due to the increase of HER, but not the decrease of CO production. This understanding is confirmed by the data as shown in FIG. 10, more details of which will be discussed next.

Referring to the data shown in FIG. 5, it is observed that the maximum selectivity was achieved at −0.52 V for all three WiS electrolytes. Maximum CO selectivity at comparably low overpotentials has been reported in the literature, and the reasons have been mainly attributed to suppressed HER and catalyst surface modifications. Given that our planar Au catalysts for all experiments were unmodified and the same, whose inherent CO selectivity as tested in $NaHCO_3$ is poor (<30%), the data was further studied as an indication that low $H_2O$ concentrations (e.g., 21 m) greatly suppress HER. The effect is most pronounced for the most concentrated solution and, hence, the highest selectivity.

Figure 11A:
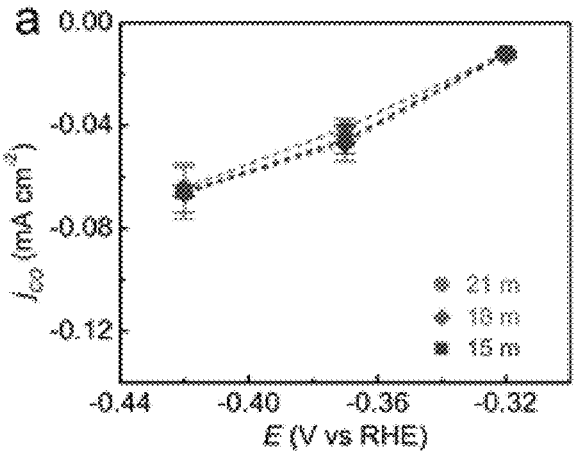
FIG. 11A-11D shows the electrokinetic analyses on $CO_2$ reduction to CO in WiS of different $H_2O$ concentrations using Au foil catalyst/electrode. (A) Partial current densities due to CO production at different potentials. (B) Partial current densities due to $H_2$ production at different potentials. (C) Tafel analyses in WiS of different $H_2O$ concentrations. (D) Partial current densities at fixed potentials for different $[H_2O]$.

The realization that the $H_2O$ concentration may be modulated in WiS through altering the salt concentrations (Table 2) prompted the study of electrokinetics of $CO_2$ reduction. For this purpose, the partial currents due to CO production (FIG. 11A) were extracted. In the low overpotential region (−0.42 V to −0.32 V), the partial current of CO increased with the increase of applied potentials. The partial current of CO remained at a relatively constant level at high overpotentials due to mass transport limitations of $CO_2$ (FIG. 10), consistent with literature reports.

Figure 11B:
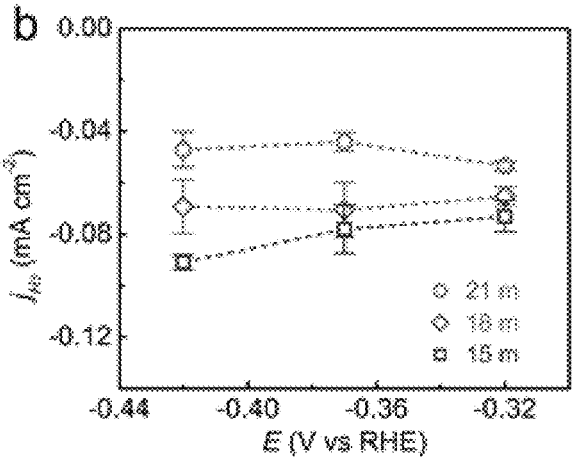
Figure 11C:
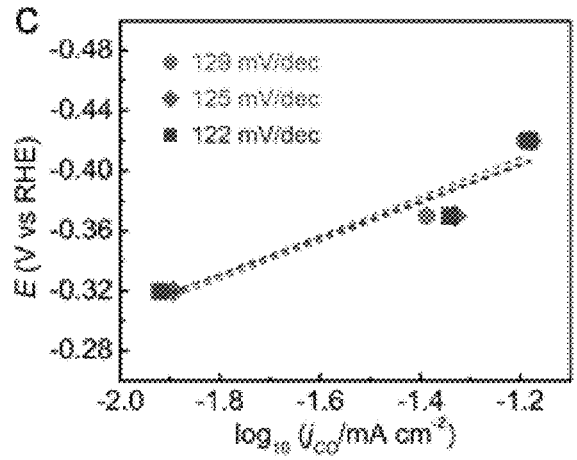
Figure 11D:
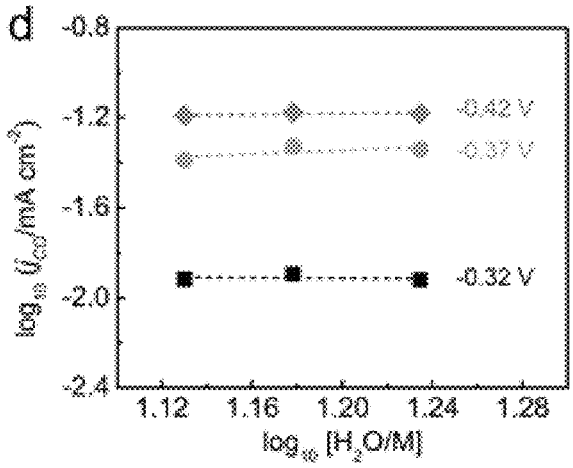

Interestingly, comparable current densities were measured for WiS electrolytes of different concentrations in the kinetically controlled region (−0.32 V to −0.42 V). The data imply that $CO_2$ electrochemical reduction kinetics is independent of $H_2O$ concentrations. This observation is in contrast to the partial current densities due to $H_2$ formation, which increased with the increase of $H_2O$ concentration monotonically (FIG. 11B). Tafel analyses indicated that in the low overpotential region, the RDS is an electrochemical step rather than a chemical step, as the Tafel slopes close to a theoretical value of 118 mV/dec were measured (FIG. 11C). To better understand the data, the partial current densities of CO (jco) at different potentials were plotted as a function of $[H_2O]$ in FIG. 11D. As expected, a pseudo $0^{th}$ order dependence was confirmed.

The possible dependence of the reaction rates on $[CO_2]$ and $[H_2O]$ in 4 different scenarios was further examined and the results were tabulated in Table 3. It is seen that only under the circumstances where ET is the RDS should one expect a $0^{th}$ order dependence of the reaction rate on $[H_2O]$. The insight is consistent with previous studies, where the partial current of CO as a function of $P_{CO2}$ and $[HCO_3^-]$ were studied. The $0^{th}$ order dependence of the reaction rate toward CO formation on $[H_2O]$ can be observed with other planar Au catalyst as well (FIG. 10).

TABLE 2

Measuring $[H_2O]$ in WiS of different concentrations.

| molality of salt/m | mass of $H_2O$/g | volume of WiS/mL | $[H_2O]$/M* |
|---|---|---|---|
| 21 | 1.7008 ± 0.001 | 7.00 ± 0.01 | 13.49 |
| 18 | 1.9842 ± 0.001 | 7.31 ± 0.01 | 15.07 |
| 15 | 2.3808 ± 0.001 | 7.70 ± 0.01 | 17.16 |

*The actual activity values of $H_2O$ ($a_{H2O}$) are expected to differ more significantly than the difference among the concentration values of $H_2O$ ($[H_2O]$), which is due to the decrease of activity coefficient values from lower ionic strength (15 m) to higher ionic strength (21 m).

TABLE 3

Electrokinetic derivations based on possible mechanisms of $CO_2$ reduction on Au.

| | rate determining steps (RDS) | reaction order $CO_2$ | reaction order $H_2O$ | rate law expressions* |
|---|---|---|---|---|
| A1 | $\theta_M + CO_{2(aq)} + e^- \rightarrow \theta_{MCOO}^-$ | 1 | 0 | $v_{CO} = \theta_M a_{CO2} \exp(-\beta FE/RT)$ |
| A2 | $\theta_{MCOO}^- + H_2O \rightarrow \theta_{MCOOH} + OH^-$ | 1 | 1 | $v_{CO} = K_{A1} \theta_M a_{CO2} a_{H2O} \exp(—FE/RT)$ |

TABLE 3-continued

Electrokinetic derivations based on possible mechanisms of $CO_2$ reduction on Au.

| | rate determining steps (RDS) | reaction order $CO_2$ | reaction order $H_2O$ | rate law expressions* |
|---|---|---|---|---|
| A3 | $\theta_{MCOOH} + H_2O + e^- \rightarrow CO + H_2O + OH^-$ | 1 | 2 | $v_{CO} = K_{A1} K_{A2} \theta_M a_{CO2} A_{H2O}^2 \exp[-(1+\beta)FE/RT]/a_{OH-}$ |
| B1 | $\theta_M + CO_{2(aq)} + e^- + H_2O \rightarrow \theta_{MCOOH} + OH^-$ | 1 | 1 | $v_{CO} = \theta_M a_{CO2} a_{H2O} \exp(-\beta FE/RT)$ |
| B2 | $\theta_{MCOOH} + H_2O + e^- \rightarrow CO + H_2O + OH^-$ | 1 | 2 | $v_{CO} = K_{B1} \theta_M a_{CO2} a_{H2O}^2 \exp[-(1+\beta)FE/RT]/a_{OH-}$ |
| C1 | $CO_{2(aq)} + H_2O + HCO_3^- \rightarrow Int^-$ | 2 | 2 | $v_{CO} = K_{acid1} Ka_{CO2}^2 a_{H2O}^2 a_{OH-}/K_w$ |
| C2 | $\theta_M + Int^- + H_2O + e^- \rightarrow \theta_{MCOOH} + H_2O + OH^- + HCO_3^-$ | 2 | 3 | $v_{CO} = K_{C1} K_{acid1} K\theta_M a_{CO2}^2 a_{H2O}^3 a_{OH-} \exp(-\beta FE/RT)/K_w$ |
| C3 | $\theta_{MCOOH} + H_2O + e^- \rightarrow CO + H_2O + OH^-$ | 1 | 2 | $v_{CO} = K_{C1} K_{C2} \theta_M a_{CO2} a_{H2O}^2 \exp[-(1+\beta)FE/RT]/a_{OH-}$ |
| D1 | $\theta_M + CO_{2(aq)} + e^- \rightarrow \theta_{MCOO}^-$ | 1 | 0 | $v_{CO} = \theta_M a_{CO2} \exp(-\beta FE/RT)$ |
| D2 | $\theta_M + H_2O + e^- \rightarrow \theta_{MH} + OH^-$ | 0 | 1 | $v_{CO} = \theta_M a_{H2O} \exp(-\beta FE/RT)$ |
| D3 | $\theta_{MCOO}^- + \theta_{MH} + H_2O \rightarrow CO + H_2O + OH^-$ | 1 | 2 | $v_{CO} = K_{D1} K_{D2} \theta_M^2 a_{CO2} a_{H2O}^2 \exp(-2FE/RT)/a_{OH-}$ |
| HER | $\theta_M + H_2O + e^- \rightarrow \theta_{MH} + OH^-$ | 0 | 1 | $v_{H2} = \theta_M a_{H2O} \exp(-\beta FE/RT)$ |
| HER1 | $2\theta_{MH} \rightarrow 2\theta_M + H_2$ | 0 | 2 | $v_{H2} = K_{HER}^2 \theta_M^2 a_{H2O}^2 \exp(-2FE/RT)/a_{OH-}^2$ |
| HER2 | $\theta_{MH} + H_2O + e^- \rightarrow \theta_M + H_2 + OH^-$ | 0 | 2 | $v_{H2} = K_{HER} \theta_M a_{H2O}^2 \exp[-(1+\beta)FE/RT]/a_{OH-}$ |

Due to the difficulty in measuring the activity coefficient of various species, the electrokinetic studies were mainly conducted by using "concentration" to substitute "activity". Maintaining a constant activity or concentration of $CO_2$ ($a_{CO2}$) was attempted by fixing the partial pressure of $CO_2$, similar to what has been done by previous studies.

A key distinction between the approach presented here and previous studies, is whether bicarbonate ($HCO_3^-$) is involved as a buffer. In the presence of a $HCO_{3-}$ buffer, the fast equilibrium between it and $CO_2$ and $H_2O$ could make the interpretation of electrokinetic data as a function of $P_{CO2}$ challenging, as has been pointed out previously. The results presented herein provide a new dimension for the understanding on the electrokinetics of $CO_2$ reduction.

The results presented herein could be readily corroborated with previous studies using $HCO_3^-$ buffer. It is noteworthy that in deriving the rate law expressions (Table 3) and analyzing the data as shown in FIG. 11, a constant $[CO_2]$ at fixed $P_{CO2}$ (1 atm) was assumed.

Figure 12A:
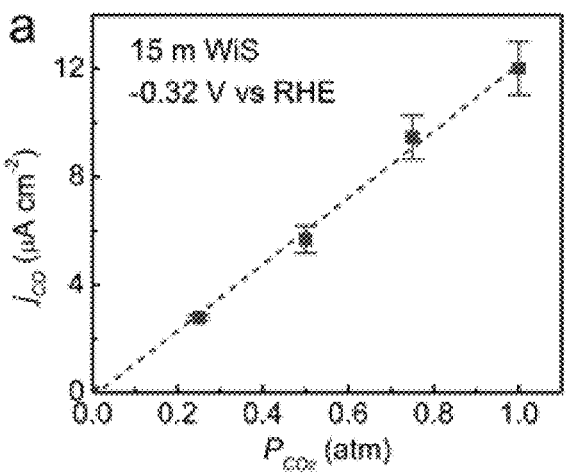
FIG. 12A-12B shows dependence of CO partial current density (jco) on the $CO_2$ partial pressure ($P_{CO2}$) using an Au foil catalyst under −0.32 V (A) and −0.37 V (B) in 15 m WiS electrolyte. A $1^{st}$ order relationship between jco and $P_{CO2}$ can be measured in both representative cases, which agrees with the ET mechanism.
Figure 12B:
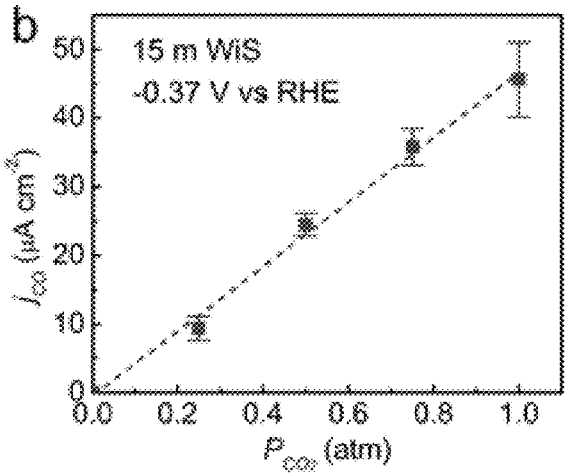

Those of skill in the art will appreciate that there is a possibility that the solubility of $CO_2$ could be slightly different for WiS of different $H_2O$ concentrations, despite the efforts of using a constant $P_{CO2}$ (1 atm) throughout the experiments. It has been previously reported that $[CO_2]$ may be sensitive to ionic strength. To understand whether changing $[CO_2]$ in WiS of different concentrations may be a complicating factor, a systematic study was carried out by measuring the partial current densities of CO (jco) as a function of $CO_2$ partial pressure ($P_{CO2}$). As shown in FIG. 12, it was observed that there is a clear $1^{st}$ order dependence of jco on $P_{CO2}$. This result indicates that measurable changes in $[CO_2]$ would be reflected in jco. That jco is independent on $[H_2O]$ in the data provided herein strongly suggests the variation of $[CO_2]$ in different WiS electrolytes is insignificant.

Figure 14:
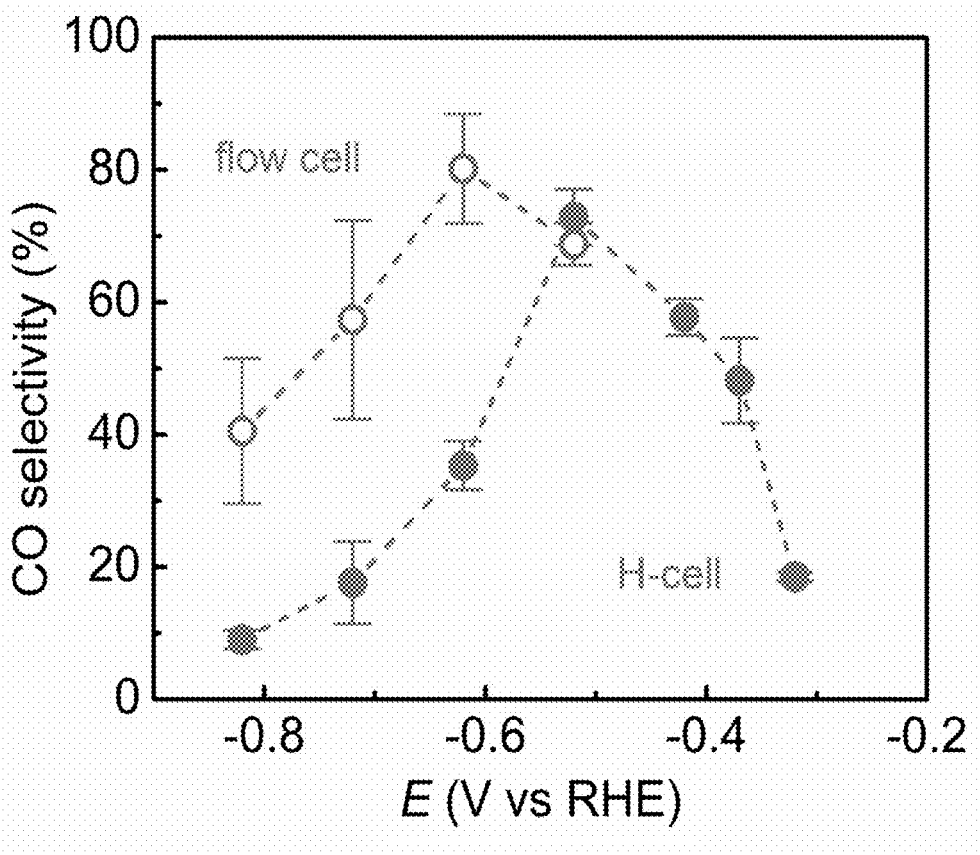
FIG. 14 shows the CO selectivity measured in 21 m WiS electrolyte in a flow cell using a gas diffusion layer (GDL) electrode with sputtered Au catalyst, shown as hollow circles in red. For comparison, the selectivity as measured in an H-cell in 21 m WiS electrolyte with Au foil catalyst from FIG. 5 is replotted here as solid circles in red. All electrolytes were saturated with $CO_2$.

As a proof-of-concept to demonstrate the potential utility of the WiS in a practical system, a flow cell design with gas diffusion layer (GDL) as an electrode (FIG. 13) was used with a goal to study whether the partial current density due to CO production could be further improved in WiS. It can be seen from FIG. 14 that in 21 m WiS, a trend of CO selectivity as a function of applied potential similar to that in a H-cell was obtained, with a slightly higher maximum selectivity (to cα. 80%).

Figure 15:
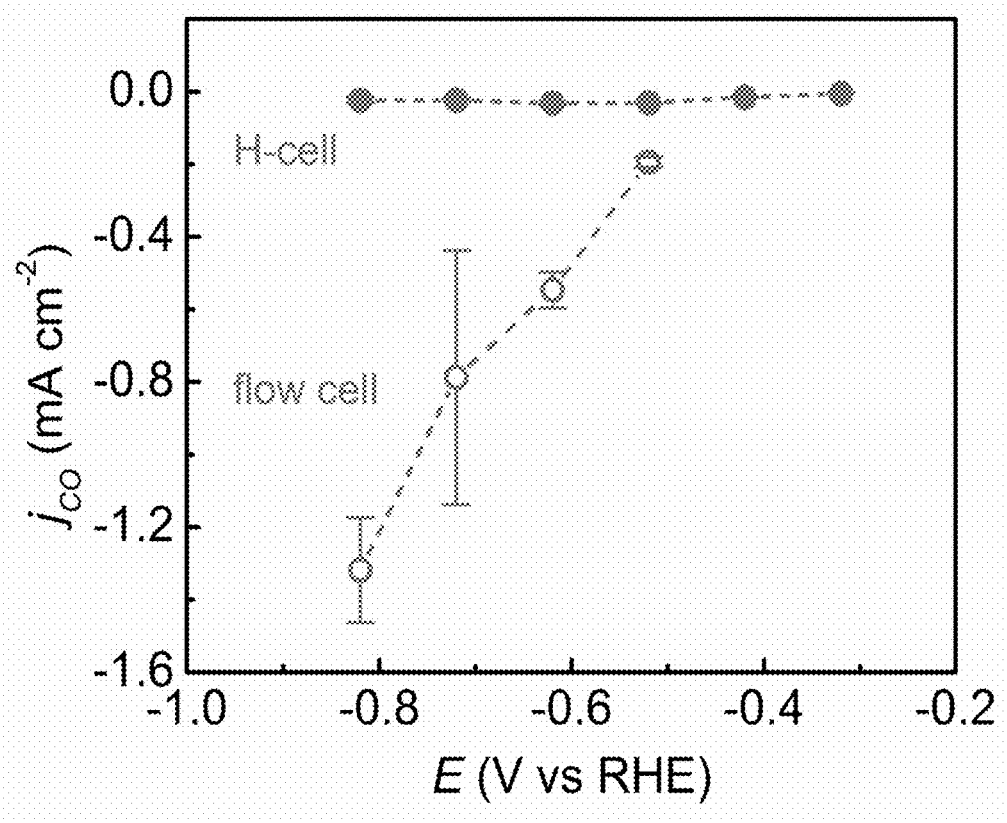
FIG. 15 shows the partial current densities of CO in a 21 m WiS electrolyte measured in a flow cell with GDL electrode and in an H-cell, both using sputtered Au catalyst.

Importantly, a significantly higher CO partial current density (up to ca. 1.3 mA/cm$^2$ at −0.82 V in a flow cell using a GDL electrode as compared to <0.1 mA/cm$^2$ at the same applied potential in a H-cell using sputtered Au catalyst, FIG. 15) was measured. This result further supports that the decrease of CO selectivity in FIG. 5 and the saturation currents as shown in FIG. 10 were indeed due to $CO_2$ mass transport limitation. It will be appreciated that the high cost of LiTFSI when scaling up the volume of the electrolyte in a flow cell may need to be addressed before WiS can be used for practical $CO_2$ reduction. Nevertheless, the most important value generated by this body of research is the advancement of our understanding on the $CO_2$ reduction mechanisms and the demonstrated potentials toward practical CO productions. Although the present study focused on $CO_2$ reduction at near neutral pH, we envision it is readily applicable to other pH's, as well, for mechanistic studies by other systems.

Discussions

The above results demonstrated that WiS can be used not only to understand the mechanism of $CO_2$ electrochemical reduction reactions, but also to improve selectivity and current densities of these reactions.

Those of skill in the art will appreciate that the nature of the proton donor (e.g., $H_2O$ or bicarbonate) may exert a profound influence on the electrokinetics. It is, however, expected that the understanding presented here to be readily transferrable. First, despite the apparent difference, $H_2O$ is the overwhelming majority chemical in both cases (bicarbonate vs. WiS). As such, the role played by $H_2O$ is not expected to be fundamentally different. Second and more importantly, the conclusion supported by our results is readily corroborated with those obtained using other methods. Taken as a whole, we conclude that ET but not CPET is the RDS during the initial steps of $CO_2$ reduction on Au in both WiS and bicarbonate-based electrolytes.

CONCLUSIONS

Without wishing to be bound by theory, it is contemplated that the strong solvation effect to the high concentration of the salt locks down the $H_2O$ molecules to change their behaviors drastically different from bulk $H_2O$. As a result, the $H_2O$ reduction activity is greatly reduced, increasing the selectivity toward CO production. Up to 80% selectivity was measured, which is to be compared with ca. 30% in the conventional electrolyte at near neutral pH. More importantly, electrokinetic studies in the kinetically controlled potential region revealed that the reaction rate exhibits a pseudo $0^{th}$ order dependence on $[H_2O]$. The results imply that an electron transfer process is rate determining. The information helps resolve diverging views on the initial steps of $CO_2$ reduction on Au catalyst and will find implications for future catalyst and electrochemical cell designs for practical $CO_2$ reduction applications.

The data provided herein demonstrates for the first time that water-in-salt electrolyte is capable of enabling $CO_2$ electrochemical reduction with high selectivity toward CO by minimizing undesired hydrogen evolution reaction. It demonstrates for the first time that the concentration of $H_2O$ can be carefully tuned by varying the amount of salt in water-in-salt electrolyte for mechanistic studies as well as performance optimization. The current disclosure describes using water-in-salt electrolyte as a suitable platform to conduct electrokinetic analyses without parasitic chemical reactions during $CO_2$ electrochemical reduction. It demonstrates that water-in-salt electrolyte can also be applied with gas diffusion electrode and flow type cell to further improve product selectivity and $CO_2$ reduction current densities.

The electrolyte and methods disclosed herein have several advantages over existing products. First, without any special treatment on Au catalyst, high selectivity toward CO with up to 80% efficiency is measured in the presently disclosed methods, in comparison with less than 30% efficiency achieved by the conventional bicarbonate electrolyte. Second, hydrogen evolution reaction (both efficiency and partial current) is greatly suppressed by the strong solvation effect of the salt to $H_2O$ molecules, in comparison with conventional electrolytes where hydrogen is the dominant product. Third, the concentration of $H_2O$ is carefully tuned in water-in-salt electrolyte for electrokinetic studies to understand reaction mechanism for the first time, which cannot be achieved by conventional aqueous electrolytes in which $H_2O$ is abundant and has to be treated as a solvent rather than a solute.

The embodiments of the present invention can be applied to the following applications, including but not limited to carbon dioxide ($CO_2$) reduction reactions to produce hydrocarbons, liquid products and forming gas, carbon monoxide (CO) reduction reactions to produce hydrocarbons and liquid products, methane ($CH_4$) oxidation reactions to produce alcohols and carbon monoxide, nitrogen ($N_2$) reduction reactions to produce ammonia and hydrazine, ammonia ($NH_3$) oxidation reactions for the application in energy storage devices, water ($H_2O$) oxidation reactions to produce oxygen and hydrogen peroxide, and oxygen ($O_2$) reduction reactions for the application in fuel cell devices. The present invention not only provides a highly effective strategy for performance optimization in the reaction schemes mentioned above, but also offers a platform to understand the reaction mechanisms especially regarding the role of $H_2O$.

Electrochemical Oxidation of Water

Materials $Co(NO_3)_2$ (99.999%, Alfa Aesar), KOH (85%, VWR International), $NaNO_3$ (99.0% min., Alfa Aesar), $NaClO_4$ (99.0% min., Alfa Aesar), $KNO_3$ (99.0% min., Sigma-Aldrich), $K_2HPO_4$ (98.0% min., Alf Aesar), $KH_2PO_4$ (98.0% min., Alf Aesar), $Na_2HPO_4$ (99.0% min., fisher chemical) and $C_2H_3NaO_2$(99.0% min., Sigma-Aldrich) were used as received. HF (48 wt. %), $NaAuCl_4 \cdot 2H_2O$ (99.99%; metals basis), $Na_2SO_3$ (98.5%; for analysis, anhydrous), $Na_2S_2O_3 \cdot 2H_2O$ (99.999%; trace metal basis), $NH_4Cl$ (99.999%; metal basis), and $KNO_3$ (99.999%, trace metal basis) were used as received from Fisher Scientific. All electrolyte solutions were prepared with deionized water (Barnstead, 18 Me-cm resistivity). $H_2{}^{18}O$ (97% enriched) was used as received from Medical Isotopes, NH. $D_2O$ (99.9%) was used as received from Aldrich.

Au Nanofilm Preparation

The gold nanofilm was electrolessly deposited onto Si wafers (IRUBIS GmbH, Germany) following the reported method. The reflective surface of the Si wafer was polished on a mat using 6 and 1 μm diamond slurries (Ted Pella; Redding, CA), then 0.05 μm alumina paste (Electron Microscopy Sciences; Hatfield, PA) with cotton swabs, for 5 min respectively. Then, the Si wafer was cleaned with five consecutive 5 min sonication in ultrapure water and acetone alternately. For the deposition, the Si wafer was first etched in 40% $NH_4F$ for 90 s to remove surface oxide and terminate the surface with hydrogen atoms. Au nanofilm was plated by immersing the Si wafer into a 2:1 mixture of a plating solution and 2% HF at 60° C. for 120 s. The plating solution contains 15 mM $NaAuCl_4 \cdot 2H_2O$, 150 mM $Na_2SO_3$, 50 mM $Na_2S_2O_3 \cdot 2H_2O$, and 50 mM $NH_4Cl$. The resulted resistance of the gold film is 5-10Ω.

Co-Pi or CoOOH Film Deposition

Co-Pi catalysts were electrodeposited onto substrates in a solution of 0.5 mM Co(NO3)2 and 0.1 M phosphate buffer (KPi) (pH-7.0) using a Solartron analytical potentiostat by potentiastatical deposition at a potential of 1.14 V vs. the normal hydrogen electrode (NHE) with the passage of 20 mC $cm^{-2}$. CoOOH electrodes were electrodeposited onto the Pt substrates or Au films in a solution of 10 mM $Co(NO_3)2$ and 0.1 M NaCH3CO2 using a VersaStat3 potentiostat (AMETEK; Berwyn, PA). The galvanostatical deposition was set at an anodic current density of 0.05 mA $cm^{-2}$ vs. Pt counter electrode for 5 min.

General Electrochemical Methods

All electrochemical experiments were conducted using a CH Instruments or Solartron analytical potentiostat, a Ag/AgCl reference electrode (0.197 V) or a saturated calomel electrode (SCE, 0.242 V), and a Pt counter electrode. Two types of substrates were used for working electrodes: fluorine-doped tin oxide (FTO) electrode and Pt rotating disk electrode. All the electrochemical measurements were conducted on Co-Pi-coated FTO electrodes in a single cell unless otherwise stated. Rotating disk electrode measurements were conducted using a Pine Instruments MSR rotator and a 5 mm diameter Pt-disk rotating electrode. All electrochemical experiments were performed using a three-electrode electrochemical cell containing a ~15 mL electrolyte solution. Unless otherwise stated, all experiments were performed at ambient temperature and electrode potentials were converted to the reversible hydrogen electrode (RHE) scale using an equation: $E(RHE)=E(RE)+E^0(RE)+0.059\times pH$, E(RHE) and E(RE) are the potential versus RHE and reference electrode, $E^0(RE)$ is the potential of reference electrode. The electrolyte resistance between working electrode (WE) and RE was measured by electrochemical impedance spectroscopy (EIS) and the resistance was used for iR compensation. E(RE)actual=E(RE)measured−iR (i and R are the values of current and solution resistance, respectively).

All the water-in-salt (WiS) electrolyte solutions used in the experiments were freshly prepared before every single test. To make the water-in-salt solutions, we first prepared KPi buffer solutions and then added salts into the KPi buffer solutions. pH of all the solutions was adjusted to 7.0 with a freshly prepared 6 M KOH solution in order to prevent the influence of pH on water oxidation activity. Based on the previous literature, water activities (αw) in 0 m NaNO3 @ 0.1 M KPi, 2 m NaNO3 @ 0.1 M KPi, 4 m NaNO3 @ 0.1 M KPi, 7 m NaNO3 @ 0.1 M KPi are calculated as 1, 0.94, 0.89, 0.83, respectively.

Details of the Electrochemical Measurements

Figure 17:
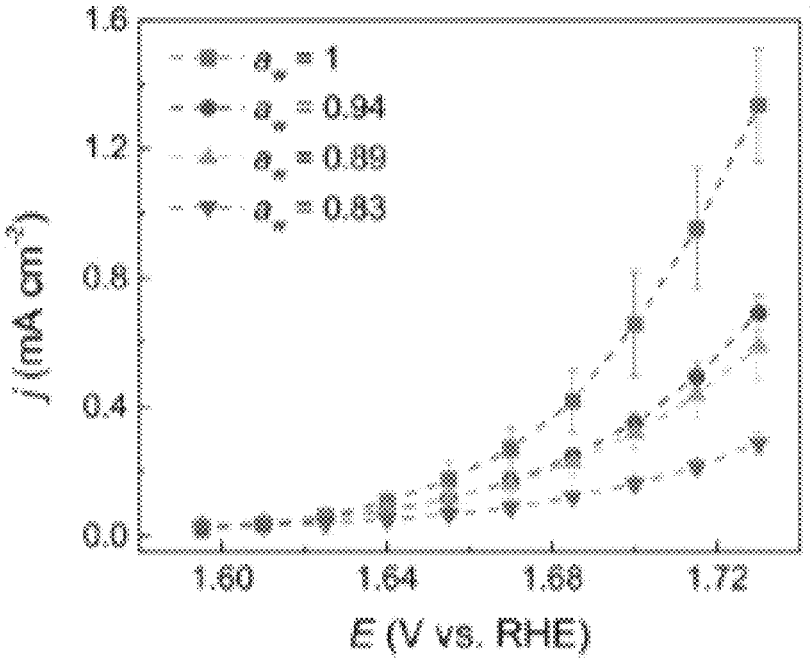
FIG. 17 shows suppression of the current density due to the water oxidation reaction on Co—Pi when aw was decreased from 1 to 0.83.
Figure 18:
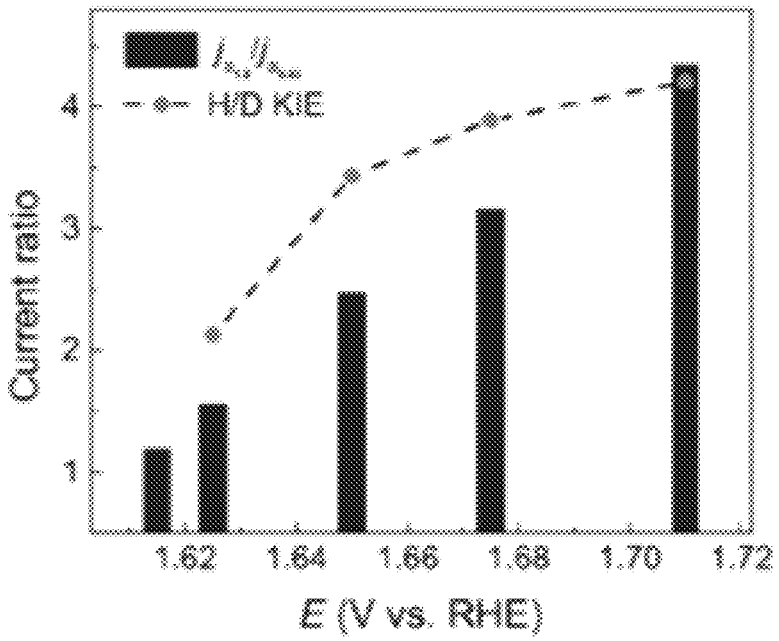
FIG. 18 shows potential-dependence of the current modulation ratio for different water activities and solvents.

The data in FIGS. 17 and 18 were collected under steady-state condition, each set of data were repeated three times with a freshly prepared catalyst of similar activity. During the data collection process, the steady-state measurement was performed for about 5 minutes until the current was stable, and then the data was processed by making an average of the last 20 raw data points in steady-state current density vs. potential (j-E) plots (FIG. S6 is a representative example of data collection). The data were collected under steady-state condition for 3 to 5 min depending on the experiment. The data was processed by making an average of the last 20 raw data points. The samples were subjected to 3 consecutive CV measurements. The second and third CV cycles show consistent result, so the third CV cycles were shown. The data was collected with the same catalyst; we first measured the cyclic voltammetry (CV) plot in $D_2O$ at a scan rate of 20 mV $s^{-1}$ and then performed the same measurement in $H_2O$.

SEIRAS-ATR Measurement

All in-situ surface-enhanced infrared absorption spectroscopy in attenuated total reflection mode (SEIRAS-ATR) measurements were carried out using nitrogen-purged Bruker Vertex 70 FTIR spectrometer (Billerica, MA) equipped with a liquid-nitrogen-cooled MCT detector (FTIR-16; Infrared Associates; Stuart, FL). The catalyst coated Si wafer was assembled into a customized polyether ether ketone (PEEK) spectroelectrochemical cell, and coupled vertically with an ATR accessory (VeeMax III; Pike Technologies; Madison, WI). All experiments were run with an incident angle of 50°, a resolution of 4 $cm^{-1}$, and a scanner velocity of 40 kHz. For all spectra shown, change in optical density was calculated according to Absorbance=− log(S/R), with S and R referring to the single beam sample spectrum and single beam reference spectrum, respectively.

Simultaneously with the infrared measurement, the CoOOH electrode was subjected to 120 s chronoamperometry from 1.61 to 2.21 V vs. RHE in 0.1 V steps connected with linear sweep voltammetry at a rate of 20 mV $s^{-1}$. A leakless Ag/AgCl (ET072-1; eDAQ, Colorado Springs, CO) and Pt wire (99.95%; BASi Inc.; West Lafayette, IN) were used as reference electrode and counter electrode, respectively. The electrolyte was prepared with 0.1 M KPi in D2O, H2O, or $H2^{18}O$ at pH=7, and the solution pD value was corrected with a factor of 0.4 from the reading of a pH meter.

Faraday Efficiency Measurement

Faradaic efficiency (FE) was measured with gas chromatography-online method (GCMS-QP2010, Shimadzu). A piece of FTO (1×3 $cm^2$) was used for growing Co-Pi catalyst. The method for growing the catalyst is the same as that described in the Co-Pi or CoOOH Film Deposition part. O2 gas was detected. During the experiment, the Co-Pi-coated FTO electrode was immersed into a reaction cell containing about 20 mL 0.1 M KPi neutral electrolyte. A constant current (3 mA) was applied to the electrode in order to generate O2 bubbles. Then, the O2 gas was further purged into the gas line of gas chromatography-mass spectrometry (GC-MS) for FE measurement. The equation for calculating FE is given by:

$$FE = \frac{4 \times \text{Oxygen amount}(\text{umol} \cdot \text{s}^{-1})}{\text{Charge}(\text{umol} \cdot \text{s}^{-1})} \times 100\%$$

Computational Details

All DFT calculations were performed with Gaussian 16 Revision C01 software package. We used the B3LYP functional in conjugation with the def2-SV(P) basis set for all atoms in the geometry optimization. Frequency analysis was performed to verify the nature of obtained stationary points and obtain harmonic frequencies to calculate the zero-point energies and thermal correction to the entropy and free energy. We used the def2-TZVP basis set for single-point energy calculation to final composite free energy changes. The solvation effect was considered the SMD implicit solvation model and the dispersion correction was considered using Grimme's empirical dispersion correction version 3 with Becke-Johnson damping. We performed geometry optimization in both gas phase and dielectric continuum with SMD. We found that the geometry relaxation in the solvation is quite significant, therefore, all the geometries except $H_2$ and $O_2$ used in the manuscript were optimized with the SMD implicit solvation model.

We considered different sizes of Co clusters and found the planar $C_{o7}O_{24}H_{27}$ cluster with edge-sharing $CoO_6$ octahedral is the most stable structure, which is consistent with the structure model suggested by EXAFS study. We considered different protonation state of the $Co_7O_{24}H_{27}$ cluster by placing protons at different O positions and found the most stable configuration corresponds to protonated J12-O and J13-O bridges, which was used for our mechanistic investigation. We simulated the O—O vibrational frequency of the O—O bond in possible intermediates. We used the atomic masses of specified isotopes and diagonal the Hessian matrix in the mass-weighted coordinates to obtain the vibrational frequency for different isotopes.

The free energy changes of proton-coupled electron transfer steps were calculated with Nørskov's computational hydrogen electrode (CHE) approach to get the free energy change with respect to the reversible hydrogen electrode (RHE) to avoid the explicit use of the hydrated proton and to include the pH effect naturally. Its procedure is given below:

1. Calculate the free energy change (ΔG1) with respect to the release of ½ equivalence of $H_2(g)$:

$$RH \rightarrow Ox + \frac{1}{2}H_2(g), \Delta G_1$$

2. Use the definition of RHE:

$$\frac{1}{2}H_2(g) \rightarrow H^+(aq)e^-, \Delta G_2$$

3. Free energy change of a proton-coupled electron transfer step (ΔG3) with respect to RHE can be calculated by adding ΔG1 and ΔG2:

$$RH \rightarrow Ox + H^+ e^-, \Delta G_3 = \Delta G_1 + \Delta G_2$$

We also considered the water oxidation mechanisms on CoOOH. Given the nature of this system, we applied periodic boundary condition to study the catalytic mechanism on CoOOH surfaces. All calculations for the CoOOH system were performed with the Vienna Ab initio Simulation Package (VASP). We use the Perdew-Burke-Ernzerhof (PBE) exchange-correlation functional in conjugation with the projected-augmented wave (PAW) method to describe the ion-electrons interactions. A cutoff energy of 500 eV was chosen for the plane wave basis set in all calculations. We used the Gaussian smearing method to accelerate SCF convergence and the o value was chosen to be 0.1 eV. The standard GGAs fail for strongly correlated systems such as the d electrons of Co. All calculations involving Ir and Ce atoms were performed with the spin-polarized DFT+U method, using the rotational-invariant formalism developed by Dudarev et al. The empirical Ueff parameters were chosen to be 3.4 eV for Co 3d electrons.

A 9×9×9 Monckhorst-Pack type k-point grid was chosen for the optimization of bulk ceria. The energy convergence criterion was set to be $10^{-6}$ eV per unit cell and the geometry convergence criterion was set to be $10^{-5}$ eV per unit cell for energy difference between two consecutive ionic steps. The optimized lattice constants α=b=2.88 Å and c=13.17 Å are in good agreement with experimental lattice constant of α=b=2.85 Å and c=13.15 Å.

We prepared slab models for the CoOOH (012) surface to study the water oxidation mechanisms on the CoOOH (012) surface. CoOOH (012) surface with 3 layers of Co atoms with both sides terminated by water ligands are used in the study. A vacuum layer of ~15 Å was used to minimize the artificial interactions between periodic images. A supercell of 13.52 Å×31.54 Å×14.37 Å was used to model the CoOOH (012) surface. The atoms in the bottom one layers were fixed at their optimized positions, while the atoms in the top two layers, as well as the adsorbates, were allowed to relax during geometry optimization. A 1×1×1 Monckhorst-Pack type k-point grid was used for all surface structure relaxations unless otherwise noted. The energy convergence criterion was set to be $10^{-5}$ eV per super cell and the force convergence criterion of 0.03 eV $Å^{-1}$.

The calculations of isolated small molecules were performed with a supercell of 15.0 Å×15.0 Å×15.0 Å. The Gaussian smearing method and a σ value of 0.1 eV were used in the calculations. A 1×1×1 Monckhorst-Pack type k-point grid was used to sample the Brillouin zone and the SCF convergence criterion was set to be $10^{-5}$ eV per unit cell.

Figure 19:
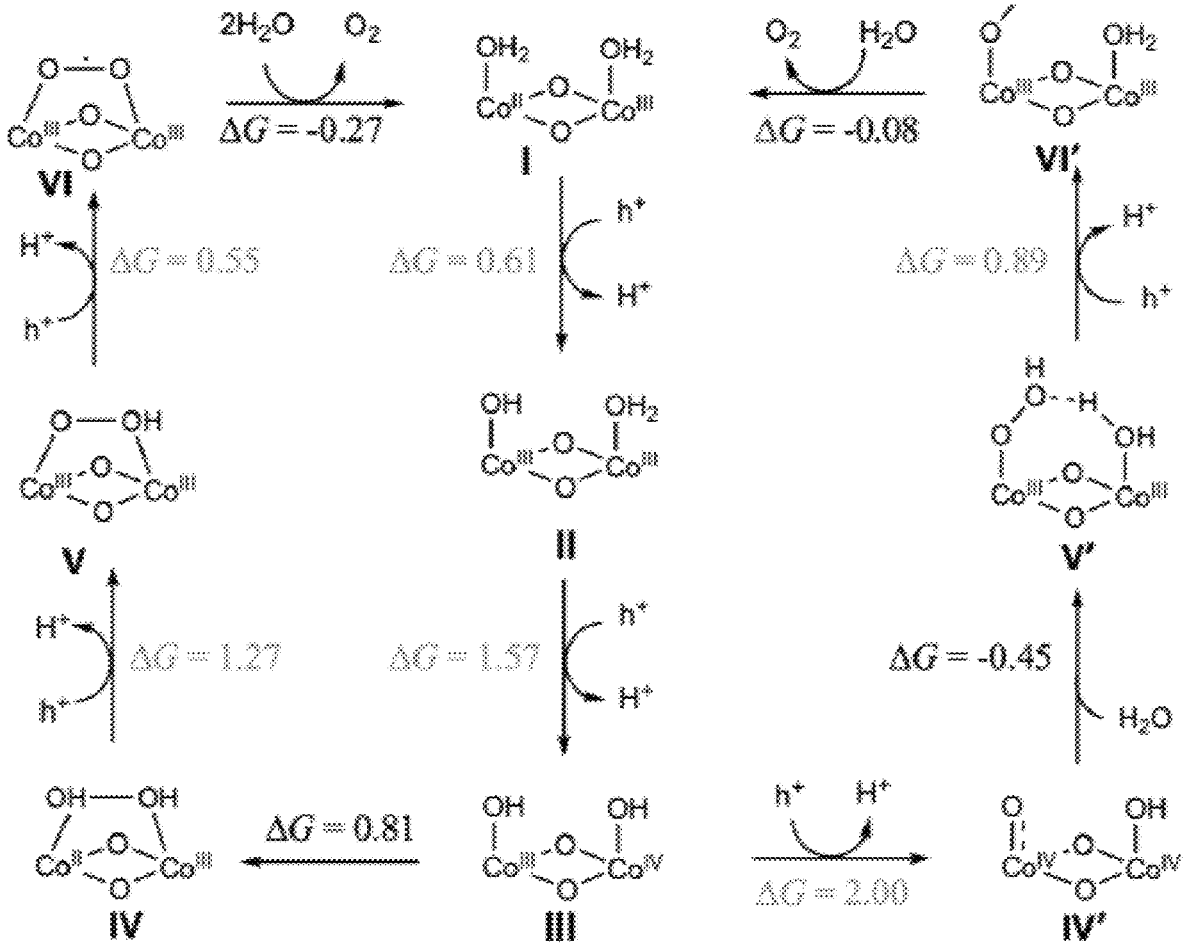
FIG. 19 shows possible routes of water oxidation on the CoOOH (012) surface suggested by the DFT calculations.

The energy changes obtained from the periodic boundary calculations were corrected by the thermo-correction from the cluster model to obtain the free energy changes given in FIG. 19. The saturated vapor pressure of water at 298.15 K (3.169 kPa) was used to obtain the free energy changes of H2O(g) El $H_2O$(1).

Results and Discussion

Detection of a Water Oxidation Intermediate

Figure 20:
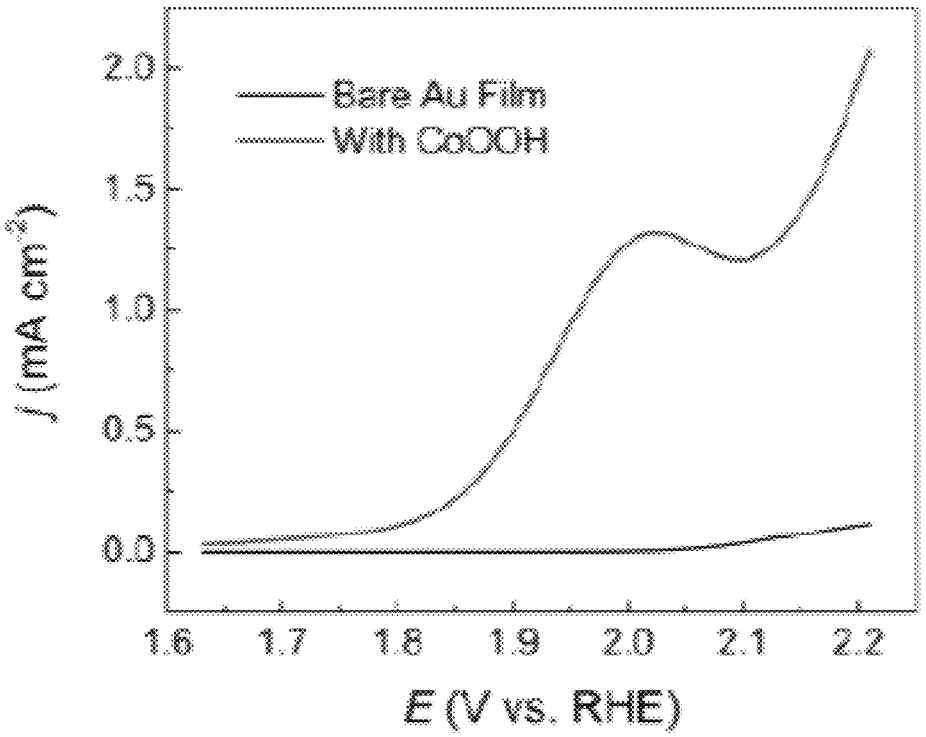
FIG. 20 shows water oxidation activity comparison between bare Au film and CoOOH—Au sample.

Surface-enhanced infrared absorption spectroscopy (SEIRAS) in the attenuated total internal reflection (ATR) geometry was used to determine the mechanism of water oxidation in the CoOOH WiS system. In SEIRAS-ATR, the surface plasmon resonance of rough metal films locally enhances the evanescent field, rendering the technique sensitive of sub-monolayers of species adsorbed on the electrode. For this purpose, a thin layer of CoOOH was deposited onto a chemically deposited Au thin film (CoOOH—Au) on a micro-machined Si-ATR crystal, which affords high infrared transparency below 1200 $cm^{-1}$. The CoOOH—Au film exhibits a large activity for water oxidation in comparison with the Au substrate as illustrated in FIG. 20.

Electrochemical Characterization with Varying Water Activities

To further probe the mechanisms the electrochemical water oxidation current was monitored as a function of electrode potential in water-in-salt electrolytes of varying water activities. As noted herein, different reaction orders with respect to water activity are expected from the two competing mechanisms: A (pseudo) first-order dependence on $H_2O$ activity (αw) is expected for the WHAA route, whereas a (pseudo) zeroth-order dependence on αw is expected for the IMOC pathway. In a practical electrochemical system, the dependence of the kinetics on αw is likely more complicated because of a number of other factors, including the participation of $H_2O$ as a solvent; these potential complications notwithstanding, there is value in quantitatively analyzing the reaction rates as a function of water activity.

FIG. 17 compares the steady-state electrochemical current densities due to the oxidation of water on Co-Pi in contact with 0.1 M KPi containing 0, 2, 4, and 7 m $NaNO_3$. The corresponding water activities are shown in the legend and were calculated on the basis of empirical equations. These values describe the activity of bulk water in these water-in-salt electrolytes. All electrolytes were at neutral pH and were stirred during measurements, which were carried out on electrodeposited Co—Pi on fluorine-doped tin oxide (FTO) substrates in a single-compartment electrochemical cell. The potential window was carefully chosen so as to avoid mass transport limitations (i.e., >1.71 V) or large experimental errors due to low current densities (i.e., <1.62 V). It was observed that with increasing molality of $NaNO_3$ and, hence, the decreasing αw, the current density of water oxidation was increasingly suppressed. A similar trend was observed for CoOOH, suggesting that the observed trend is a more general feature of cobalt oxide-based catalysts.

The observed suppression of the water oxidation reaction could arise from a number of different physical phenomena. First, to test if the catalyst undergoes irreversible structural changes in the different electrolytes, we recorded the CVs of the same Co-Pi electrode in 0.1 M KPi before and after collection of a series of CVs in the four water-in-salt electrolytes (of molalities 0, 2, 4, 7 m). The CVs in 0.1 M KPi before and after catalysis in the water-in-salt electrolytes were observed to overlap, suggesting that no irreversible structural changes of the catalyst occur during water oxidation in the water-in-salt electrolytes.

Further, the steady-state electrochemical current densities of a Co-Pi-coated Pt rotating disk electrode (RDE) at rotation rates of 2,000 rpm and 0 rpm suggested that the suppression of the water oxidation reaction is not caused by limited mass transport of water to the electrode.

Furthermore, control experiments for excluding local pH effects as a possible reason for reactivity trends with increasing $NaNO_3$ concentration suggest that the local pH does not significantly depend on the concentration of $NaNO_3$. The control experiments included: (1) monitoring the electrochemical current density as a function of solution pH at a fixed (absolute) electrode potential, (2) galvanostatic titration experiments; and (3) varying the concentration of KPi in the electrolytes containing 4 and 7 m $NaNO_3$.

In addition, testing whether nitrate anions block catalytic sites indicated that nitrate anions do not block catalytic sites of Co-Pi.

Next, to test if the catalytic activity is affected by the identity of the cation, additional control experiments in 2 m $KNO_3$ were conducted. It was observed that the current modulation ratio virtually overlapped with the one obtained in 2 m $NaNO_3$ (higher concentrations of $KNO_3$ could not be tested because of the lower solubility of that salt relative to $NaNO_3$). These results lead to the inference that the substitution of $K^+$ in Co—Pi by $Na^+$ has no significant impact on the catalytic activity of this catalyst. Thus, the incorporation of $Na^+$ into the Co—Pi film can be excluded as the origin of the change in catalytic activity with increasing electrolyte concentration.

CV tests in electrolytes with reagent grade and trace metal grade salts indicated that water oxidation activity was observed in both electrolytes. Lastly, gas chromatography measurements indicate that (1) other possible oxidation products (such as H2O2) are not produced in appreciable amounts and (2) parasitic chemical reactions (such as the oxidation of nitrate) do not occur.

Thus, it was observed that the observed suppression of the water oxidation reaction may likely due to the decrease of water activity ($\alpha_w$) from 1 to 0.83 as the concentration of $NaNO_3$ increases from 0 to 7 m.

Data from FIGS. 17 and 18, showing the ratio of current density at $\alpha_w$=1 over that at $\alpha_w$=0.83 at different potentials indicates that the reaction rate of water oxidation is modulated by the water activity, and that the water activity is strongly dependent on electrode potential. That the reaction rate is suppressed by up to a factor of 4.3 by an $\alpha_w$ change from 1 to 0.83 at 1.71 V strongly suggests that H2O is involved in the rate-determining step at that potential. Conversely, for the same $\alpha_w$, the modulation is close to unity at 1.615 V, indicating that H2O involvement in the rate-determining step is less likely. Taken as a whole, the data suggest that a mechanistic switch occurs between 1.615 V and 1.71 V. A possible mechanistic switch that is consistent with our observations is the transition from the IMOC pathway ((pseudo) zeroth-order in $\alpha_w$) to the WHAA route ((pseudo) first-order in $\alpha_w$) as the electrode potential is increased from 1.615 to 1.71 V.

Thus, new insights have been gained in probing the kinetics of heterogeneous water oxidation by varying water activities. It was learned that the rate and mechanism of water oxidation reaction are both sensitive to a number of factors, including the local catalytic environment (e.g., the availability of mononuclear, dinuclear or multinuclear active centers), substrate concentration, as well as the driving forces. Thus, the generation of electrons and protons from a water oxidation reaction and the rate thereof can be advantageously tailored by changing the water activity using a water-in-electrolyte system.

The present invention can also be used to solve problems, including but not limited to (1) low efficiency and poor selectivity in the reactions mentioned above by using the existing electrolyte systems; (2) lack of mechanistic understanding and difficulty in conducting mechanistic studies on the reactions mentioned above by using the existing electrolyte systems.

What is claimed is:

1. A flow cell for reducing carbon dioxide, the flow cell comprising:

a first chamber having a gold coated gas diffusion layer working electrode, a reference electrode, and a water-in-salt electrolyte comprising a concentrated aqueous solution of lithium bis-(trifluoromethanesulfonyl)imide (LiTFSI);

a second chamber adjacent the first chamber and having gold coated gas diffusion layer counter electrode and the water-in-salt electrolyte, the second chamber being separated from the first chamber by a proton exchange membrane; and a reservoir containing a volume of the water-in-salt electrolyte and a head space, the reservoir being coupled to each of the first and the second chambers with a pump.

2. The flow cell of claim 1, wherein a volume ratio of the water-in-salt electrolyte to the head space in the reservoir is in a range from 3-5.

3. The flow cell of claim 1, wherein the reference electrode comprises a lithium-iron-phosphate electrode.

4. The flow cell of claim 1, wherein the proton exchange membrane comprises Nafion.

5. The flow cell of claim 1, wherein LiTFSI is present in the water-in-salt electrolyte at a molality in a range from 15 mole/kg to 21 mole/kg.

6. The flow cell of claim 1, wherein the water-in-salt electrolyte has a pH in a range from 5 to 7 as measured by a double-junction pH electrode.

7. The flow cell of claim 1, wherein water is present in the water-in-salt electrolyte at a concentration in a range from 13 M to 18 M.

8. The flow cell of claim 1, wherein the water-in-salt electrolyte from both the first and the second chambers is saturated with carbon dioxide.

9. A method of reducing carbon dioxide to carbon monoxide, the method comprising:

saturating a water-in-salt electrolyte in a flow cell with carbon dioxide; and applying a potential across a working electrode and a counter electrode of the flow cell, wherein the flow cell comprises a first chamber having a gold coated gas diffusion layer as the working electrode, a reference electrode, and the water-in-salt electrolyte comprises a concentrated aqueous solution of lithium bis-(trifluoromethanesulfonyl)imide (LiTFSI), a second chamber adjacent the first chamber and having gold coated gas diffusion layer as the counter electrode and the water-in-salt electrolyte, the second chamber being separated from the first chamber by a proton exchange membrane, and a reservoir containing a volume of the water-in-salt electrolyte and a head space, the reservoir being coupled to each of the first and the second chambers with a pump.

10. The method of claim 9, wherein the potential applied across the working electrode and the counter electrode is in a range from −0.8 V to −0.3 V measured relative to a reversible hydrogen electrode.

11. The method of claim 9, wherein partial pressure of carbon dioxide in each of the first and second chambers of the flow cell is in a range from 0.2 atm to 1 atm.

12. The method of claim 9, further comprising:

measuring a selectivity ratio of partial current density due to carbon monoxide to partial current density due to carbon monoxide and partial current density due to hydrogen; and adjusting one or both of a partial pressure of carbon dioxide in the water-in-salt electrolyte and the applied potential so as to maximize selectivity ratio.

13. The method of claim 9, wherein the water-in-salt electrolyte has a pH in a range from 5 to 7 as measured by a double-junction pH electrode.

14. The method of claim 9, wherein LiTFSI is present in the water-in-salt electrolyte at a molality in a range from 15 mole/kg to 21 mole/kg.

15. The method of claim 9, wherein water is present in the water-in-salt electrolyte at a concentration in a range from 13 M to 18 M.

16. The method of claim 9, wherein the reference electrode comprises a lithium-iron-phosphate electrode.

* * * * *